US010919335B2

(12) United States Patent
Wen et al.

(10) Patent No.: US 10,919,335 B2
(45) Date of Patent: Feb. 16, 2021

(54) DIRECT-LIQUID WRITING INSTRUMENT

(71) Applicant: NINGBO WUYUN PEN MANUFACTURING CO., LTD., Yuyao (CN)

(72) Inventors: Yang Wen, Yuyao (CN); Xiangyang Wen, Simen Town (CN); Liping Wang, Yuyao (CN)

(73) Assignee: NINGBO WUYUN PEN MANUFACTURING CO., LTD., Yuyao (CN)

( * ) Notice: Subject to any disclaimer, the term of this patent is extended or adjusted under 35 U.S.C. 154(b) by 76 days.

(21) Appl. No.: 15/758,110

(22) PCT Filed: Feb. 1, 2016

(86) PCT No.: PCT/CN2016/073045

§ 371 (c)(1),
(2) Date: Apr. 19, 2019

(87) PCT Pub. No.: WO2017/041424

PCT Pub. Date: Mar. 16, 2017

(65) Prior Publication Data

US 2019/0248171 A1 Aug. 15, 2019

(30) Foreign Application Priority Data

Sep. 7, 2015 (CN) ..... 201510562402.5

(51) Int. Cl.
*B43K 5/00* (2006.01)
*B43K 8/04* (2006.01)
(Continued)

(52) U.S. Cl.
CPC ..... *B43K 8/04* (2013.01); *B43K 5/02* (2013.01); *B43K 5/18* (2013.01); *B43K 7/10* (2013.01); *B43K 8/03* (2013.01)

(58) Field of Classification Search
CPC ... B43K 8/03; B43K 8/04; B43K 5/02; B43K 5/18; B43K 7/10
(Continued)

(56) References Cited

U.S. PATENT DOCUMENTS 6,095,707 A 8/2000 Kaufmann
6,607,325 B2 * 8/2003 Hori ..... B43K 8/03 401/205
2003/0068191 A1 4/2003 Hori

FOREIGN PATENT DOCUMENTS

CN 1749029 A 3/2006
CN 101032905 A 9/2007
(Continued)

*Primary Examiner* — Jennifer C Chiang
(74) *Attorney, Agent, or Firm* — Neal, Gerber & Eisenberg LLP

(57) ABSTRACT

A direct-liquid writing instrument includes a penholder, an ink feeder and a nib. One end of the penholder is provided with a writing portion, and the other end of the penholder is provided with an ink storage portion. The nib is partially inserted into the writing portion. The direct-liquid writing instrument also includes a first baffle and a second baffle that are spaced apart from each other to form an air barrier layer. The first baffle is in contact with the ink of the ink storage portion, and the second baffle is adjacent the writing portion. Additionally, the first baffle is provided with a first air-guiding channel, and a second air-guiding channel is provided between the second baffle and the ink feeder. The ink feeder passes through the first baffle, the air barrier layer, and the second baffle to deliver the ink to the nib.

24 Claims, 16 Drawing Sheets

(51) Int. Cl.

| | |
|---|---|
| ***B43K 5/18*** | (2006.01) |
| ***B43K 7/10*** | (2006.01) |
| ***B43K 5/02*** | (2006.01) |
| ***B43K 8/03*** | (2006.01) |

(58) Field of Classification Search
USPC ..... 401/199
See application file for complete search history.

(56) References Cited

FOREIGN PATENT DOCUMENTS

| | | | |
|---|---|---|---|
| CN | 203974294 | U | 12/2014 |
| CN | 203974295 | U | 12/2014 |
| CN | 204451619 | U | 7/2015 |
| CN | 204506218 | U | 7/2015 |
| CN | 105172422 | A | 12/2015 |
| CN | 105196735 | A | 12/2015 |
| CN | 204936581 | U | 1/2016 |
| CN | 105313536 | A | 2/2016 |
| JP | 2534821 | | 11/1994 |
| JP | 2004042262 | A | 2/2004 |

* cited by examiner

DIRECT-LIQUID WRITING INSTRUMENT

TECHNICAL FIELD

The present invention relates to the technical field of office supplies, in particular to a writing instrument, and more particularly to a direct-liquid writing instrument.

BACKGROUND ART

Writing instruments such as a marker, a whiteboard marker, a highlighter pen, etc. generally use a core or a cotton tube as an ink storage medium. However, this kind of ink storage mediums generally has several disadvantages as follows.

First, the storage capacity of ink is very limited, due to the volume of the core or the cotton tube itself. Second, the handwriting becomes lighter, as the amount of ink per unit length of writing decreases gradually during the writing process. Third, even when the writing quality is significantly degraded and difficult to use, typically, there are still 30 percent or more of the ink remaining in the core or the cotton tube.

Therefore, problems of low storage capacity, instable output, low ink utilization rate, etc. exist in the writing instrument of such kind of ink storage mediums, which leads to frequent replacement of the writing instrument, inconvenient usage, waste of ink and other materials, environmental pollution, etc.

Direct-liquid writing instruments have a large storage capacity of ink, and it could solve the problems above in a targeted manner. For example, JP Patent 2534821 discloses a direct-liquid writing instrument, which is equipped with an ink supply mechanism capable of performing gas-liquid exchange.

However, such ink supply mechanism has disadvantages of complexity of design, high precision requirements, and difficulty for manufacturing, as it conducts air through the capillary channel.

When the pressure in the ink tube varies, the ink would enter into the liquid storage chamber through the capillary channel. The liquid storage chamber is provided with an inverted V-shaped portion for preventing outflow surrounding the ink supply channel.

U.S. Pat. No. 6,095,707 and U.S. Patent Publication No. US20030068191A1 both design a direct-liquid writing instrument with a capillary storage, wherein an ink feeder connects a nib and ink in the ink tube, and the capillary storage wraps around the ink feeder. When the external temperature and pressure change slightly, the capillary storage could absorb the excess ink released from the ink tube to prevent leakage. However, when great changes occur, it is not easy to prevent.

Two Chinese patents with Publication No. CN1749029A and CN101032905A design a direct-liquid writing instrument with a plurality of communicating tubes. The communicating tubes are inserted in the ink absorbing portion and communicating with the ink in the ink tube, wherein a nib is inserted in the ink absorbing portion. However, this design would easily cause ink leakage under negative pressure.

SUMMARY OF THE INVENTION

In order to overcome the above-mentioned drawbacks in the prior art, an object of the present invention is to provide a direct-liquid writing instrument with the advantages of a large storage capacity, less residuals, fluency for writing, and prevention to leakage under great variations in external temperature and pressure.

Another object of the present invention is to provide a direct-liquid writing instrument with the advantages of a large storage capacity, prevention to leakage, fluency for writing, and minimal residuals.

Another object of the present invention is to provide a direct-liquid writing instrument, with the advantages of a simple structure, easy availability of raw materials, and simple production.

Another object of the present invention is to provide a direct-liquid writing instrument with the advantages of a stable structure, resistance to pressure and temperature difference, and convenience to transport.

Another object of the present invention is to provide a direct-liquid writing instrument with the advantages of a large storage capacity, high ink utilization rate, convenience to use, less waste and environmental pollution.

In order to achieve the above objects, a direct-liquid writing instrument of the present invention comprises a penholder, an ink feeder and a nib, wherein one end of the penholder is provided with a writing portion, the other end of the penholder is provided with an ink storage portion, and the nib is partially inserted into the writing portion, and it further comprises: an adjusting portion, comprising a first baffle and a second baffle, wherein the first baffle and the second baffle are spaced apart so that an air barrier layer is formed between the two baffles, the first baffle is in contact with the ink of the ink storage portion, the second baffle is adjacent to the writing portion, the ink feeder passes through the first baffle, the air barrier layer, and the second baffle, two ends of the ink feeder are in contact with the ink and the nib respectively so as to deliver the ink to the nib, the first baffle is provided with a first air-guiding channel, through the first air-guiding channel the ink storage portion is connected to the air barrier layer, a second air-guiding channel is provided between the second baffle and the ink feeder, wherein at least one gap is formed between the second air-guiding channel and the ink feeder, and the air barrier layer is connected to the writing portion through the second air-guiding channel.

Thereby, the adjusting portion is air-permeable and liquid-impermeable, as it is provided between the ink storage portion and the writing portion of the penholder to block the ink in the ink storage portion from flowing to the writing portion. The writing portion communicates with the ink storage portion and the external environment, which could automatically balance the pressure in the ink storage portion.

The above "air-permeable and liquid-impermeable" means that air can pass through but ink (liquid) cannot when there is no pressure difference between the ink storage portion and the outside.

The first air-guiding channel could be any suitable structure. Preferably, the first air-guiding channel is a first air-guiding hole and/or a first air-guiding tube, and the first air-guiding hole/tube extends into the air barrier layer. In a specific embodiment of the present invention, the first air-guiding channel is a first air-guiding hole; in another specific embodiment of the present invention, the first air-guiding channel is a first air-guiding tube; in another specific embodiment of the present invention, the first air-guiding channel is a combination of the first air-guiding hole and the first air-guiding tube.

The dimension of the adjusting portion along the longitudinal direction of the penholder can be determined according to needs. Preferably, the dimension of the adjusting portion along the longitudinal direction of the penholder is from 2 mm to 50 mm, or from 10 mm to 30 mm, to meet the requirements of adjusting performances of different ink leakage. In a specific embodiment of the present invention, the dimension of the adjusting portion along the longitudinal direction of the penholder is 2 mm; in another specific embodiment of the present invention, the dimension of the adjusting portion along the longitudinal direction of the penholder is 10 mm; in another specific embodiment of the present invention, the dimension of the adjusting portion along the longitudinal direction of the penholder is 20 mm; in another specific embodiment of the present invention, the dimension of the adjusting portion along the longitudinal direction of the penholder is 30 mm; in a specific embodiment of the present invention, the dimension of the adjusting portion along the longitudinal direction of the penholder is 50 mm; in a specific embodiment of the present invention, the dimension of the adjusting portion along the longitudinal direction of the penholder is 32 mm. In a specific embodiment of the present invention, the dimension of the adjusting portion along the longitudinal direction of the penholder is 38 mm.

The dimension of the first air-guiding channel in the air barrier layer extending along the longitudinal direction of the penholder can be determined according to needs. Preferably, the dimension of the first air-guiding channel in the air barrier layer extending along the longitudinal direction of the penholder is from 0 to a value of the dimension of the air barrier layer along the longitudinal direction of the penholder, or from 5 mm to 20 mm, to meet the requirements of adjusting performances of different ink leakage. In a specific embodiment of the present invention, the dimension of the first air-guiding channel in the air barrier layer extending along the longitudinal direction of the penholder is 0; in another specific embodiment of the present invention, the dimension of the first air-guiding channel in the air barrier layer extending along the longitudinal direction of the penholder is 5 mm; in another specific embodiment of the present invention, the dimension of the first air-guiding channel in the air barrier layer extending along the longitudinal direction of the penholder is 10 mm; in another specific embodiment of the present invention, the dimension of the first air-guiding channel in the air barrier layer extending along the longitudinal direction of the penholder is 20 mm; in another specific embodiment of the present invention, the dimension of the first air-guiding channel in the air barrier layer extending along the longitudinal direction of the penholder is a value of the dimension of the air barrier layer along the longitudinal direction of the penholder (in this specific embodiment is 30 mm)

Preferably, the diameter of the first air-guiding channel is from 0.1 mm to 3 mm, or from 0.5 mm to 1.5 mm, to meet the requirements of adjusting performances of different ink leakage. In a specific embodiment of the present invention, the diameter of the first air-guiding channel is 0.1 mm; in another specific embodiment of the present invention, the diameter of the first air-guiding channel is 0.2 mm; in another specific embodiment of the present invention, the diameter of the first air-guiding channel is 0.5 mm; in another specific embodiment of the present invention, the diameter of the first air-guiding channel is 1 mm; in another specific embodiment of the present invention, the diameter of the first air-guiding channel is 1.5 mm; in another specific embodiment of the present invention, the diameter of the first air-guiding channel is 3 mm.

In order to better meet the requirements of adjusting performances of ink leakage, in a specific embodiment of the present invention, the end of the first air-guiding channel, away from the first baffle, is tapered in diameter.

The number of the first air-guiding channel can be determined according to needs. In a specific embodiment of the present invention, the number of the first air-guiding channel is 1; in order to meet the requirements of adjusting performances of different ink leakage, the first air-guiding channel can also be provided in plural, and the plurality of the first air-guiding channels are in contact with or spaced from each other.

The second air-guiding channel could be any suitable structure. Preferably, the second air-guiding channel is a second air-guiding hole and/or a second air-guiding tube, and the second air-guiding hole/tube extends into the air barrier layer. In a specific embodiment of the present invention, the second air-guiding channel is a second air-guiding hole; in another specific embodiment of the present invention, the second air-guiding channel is a second air-guiding tube.

The dimension of the second air-guiding channel in the air barrier layer extending along the longitudinal direction of the penholder can be determined according to needs. Preferably, in order to meet the requirements of adjusting performances of different ink leakage, the dimension of the second air-guiding channel in the air barrier layer extending along the longitudinal direction of the penholder is from 0 to a value of the dimension of the air barrier layer along the longitudinal direction of the penholder, or from 5 mm to 20 mm. In a specific embodiment of the present invention, the dimension of the second air-guiding channel in the air barrier layer extending along the longitudinal direction of the penholder is 0; in another specific embodiment of the present invention, the dimension of the second air-guiding channel in the air barrier layer extending along the longitudinal direction of the penholder is 5 mm; in another specific embodiment of the present invention, the dimension of the second air-guiding channel in the air barrier layer extending along the longitudinal direction of the penholder is 10 mm; in another specific embodiment of the present invention, the dimension of the second air-guiding channel in the air barrier layer extending along the longitudinal direction of the penholder is 20 mm; in another specific embodiment of the present invention, the dimension of the second air-guiding channel in the air barrier layer extending along the longitudinal direction of the penholder is a value of the dimension of the air barrier layer along the longitudinal direction of the penholder (in this specific embodiment is 36 mm).

The diameter of the second air-guiding channel can be determined as needed. To meet the requirements of different ink leakage adjustment performances, preferably, the second air-guiding channel is greater than the diameter of the ink feeder by 0.05 mm to 2 mm, or by 0.2 mm to 0.8 mm.

In one embodiment of the invention, the second air-guiding channel is greater than the diameter of the ink feeder by 0.05 mm; in one embodiment of the invention, the second air-guiding channel is greater than the diameter of the ink feeder by 0.2 mm; in one embodiment of the invention, the second air-guiding channel is greater than the diameter of the ink feeder by 0.4 mm; in one embodiment of the invention, the second air-guiding channel is greater than the diameter of the ink feeder by 0.8 mm; in one embodiment of the invention, the second air-guiding channel is greater than the diameter of the ink feeder by 2 mm; in one embodiment of the invention, the second air-guiding channel is greater than the diameter of the ink feeder by 0.6 mm; in one embodiment of the invention, the second air-guiding channel is greater than the diameter of the ink feeder by 0.5 mm.

The gap can be formed at any position of the second air-guiding channel along the longitudinal direction of the penholder, or even at all positions. In one embodiment of the invention, the gap is formed at the end of the second air-guiding channel adjacent to the first baffle, wherein the air barrier layer is connected to the interior of the second air-guiding channel through the gap and the interior of the second air-guiding channel is connected to the writing portion; in one embodiment of the invention, the gap is formed at the middle of the second air-guiding channel, wherein the air barrier layer is connected to the writing portion through the second air-guiding channel and the gap; in one embodiment of the invention, the gap is formed at the end of the second air-guiding channel away from the first baffle, wherein the air barrier layer is connected to the writing portion through the second air-guiding channel and the gap.

The gap above may be an annular hole between the second air-guiding channel and the ink feeder, or may be formed by a partial contact between the second air-guiding channel and the ink feeder. For example, the gap may be formed by the concave portions of the second air-guiding channel and/or the ink feeder, or by providing convex ribs between the second air-guiding channel and the ink feeder, or may be formed by the differences in cross-section between the second air-guiding channel and the ink feeder. For example, the cross section of the second air-guiding channel is hexagonal and the cross section of the ink feeder is circular, and the two are tangentially formed.

The width of the gap is the distance of the gap along the circumferential direction of the ink feeder. As described above, the gap may be an annular hole so that the maximum width can be the perimeter of the annular hole. When the widths of the gap along the radial direction of the second air-guiding channel are different, the maximum value is taken and the specific distance can be determined as needed. Preferably, the distance is from 0.1 mm to a value of the dimension surrounding the entire ink feeder, or from 0.3 mm to 1.0 mm. In one embodiment of the invention, the distance is 0.1 mm; in one embodiment of the invention, the distance is 0.3 mm; in one embodiment of the invention, the distance is 0.4 mm. In one embodiment of the invention, the distance is 0.5 mm; in one embodiment of the invention, the distance is 0.6 mm; in one embodiment of the invention, the distance is 0.8 mm; In one embodiment of the invention, the distance is 1.0 mm; in one embodiment of the invention, the distance is the dimension surrounding the entire ink feeder (in this embodiment, specifically 3 mm).

The thickness of the gap is the distance of the gap along the radial direction of the ink feeder, and the distance may be determined as needed. Preferably, the distance is 0.02 mm to 0.2 mm, or from 0.04 mm to 0.1 mm. In one embodiment of the invention, the distance is 0.02 mm; in one embodiment of the invention, the distance is 0.04 mm; in one embodiment of the invention, the distance is 0.08 mm; in one embodiment of the invention, the distance is 0.1 mm; in one embodiment of the invention, the distance is 0.2 mm.

The height of the gap is the distance of the gap along the length of the penholder, and the distance may be determined as needed. Preferably, the distance is 0.1 mm to a value of the dimension of the second air-guiding channel in the air barrier layer extending along the longitudinal direction of the penholder, or from 1.0 mm to 3.0 mm. In one embodiment of the invention, the distance is 0.1 mm; in one embodiment of the invention, the distance is 0.2 mm; in one embodiment of the invention, the distance is 0.5 mm; in one embodiment of the invention, the distance is 1.0 mm; in one embodiment of the invention, the distance is 2.0 mm; in one embodiment of the invention, the distance is 3.0 mm; in one embodiment of the invention, the distance is the dimension of the second air-guiding channel in the air barrier layer extending along the longitudinal direction of the penholder (in this embodiment, specifically 36 mm).

The shape of the gap can be arbitrary. Preferably, the shape of the gap is annular, rectangular, fan-shaped or others such as triangular, etc. In one embodiment of the invention, the shape of the gap is annular; in one embodiment of the invention, the shape of the gap is rectangular; in one embodiment of the invention, the shape of the gap is fan-shaped.

The number of the gaps can be determined as needed, and preferably, the number of gaps is plural.

In one embodiment of the invention, the number of gaps is 1. To meet the requirements of different ink leakage adjustment performances, the number of gaps can also be plural. More preferably, the number of the gaps is 2 to 4. In one embodiment of the invention, the number of the gaps is 4; in one embodiment of the invention, the number of the gaps is 5; in one embodiment of the invention, the number of the gaps is 6; in one embodiment of the invention, the number of the gaps is 2; in one embodiment of the invention, the number of the gaps is 10.

The number of the adjusting portions can be determined as needed. In one embodiment of the invention, the number of the adjusting portions is 1. To meet the requirements of different ink leakage adjustment performances, the number of the adjusting portions can also be plural, and the plurality of the adjusting portions are sequentially provided along the longitudinal direction of the penholder, in contact with or spaced from each other. The first baffle closest to the adjusting portion of the ink storage portion is in contact with the ink of the ink storage portion, and the second baffle closest to the adjusting portion of the writing portion is adjacent to the writing portion. In addition, if the plurality of the adjusting portions is spaced from each other, the spacer could be filled with air or ink. In one embodiment of the invention, the number of the adjusting portions is 2, and the two adjusting portions are spaced from each other, and the spacer is filled with air.

In order to further reduce the amount of the remaining ink, in one embodiment of the invention, the surface of the first baffle toward the ink storage portion is provided with an ink-guiding groove along the direction toward the ink feeder.

The shape of the ink-guiding groove can be determined as needed. In one embodiment of the invention, the ink-guiding groove is a spiral groove and/or a wedge-shaped groove.

In order to better reduce the amount of the remaining ink, in one embodiment of the invention, the width of the ink-guiding groove tapers in the direction toward the ink feeder, and/or the surface of the first baffle towards the ink storage portion is leaned along the direction from the ink storage portion to the writing portion. That is, the surface of the first baffle towards the ink storage portion is disposed at an acute angle with the ink feeder so that the height of the ink-guiding groove gradually tapers in the direction toward the ink feeder.

In order to further improve the ability to prevent ink leakage of the direct-liquid writing instrument of the present invention, in one embodiment of the invention, the direct-liquid writing instrument further comprises:

a buffer storage portion, provided in the writing portion and wrapping at least a portion of ink feeder in the writing portion so as to absorb the excess ink exuding from the ink feeder.

The buffer storage portion can only wrap a portion of ink feeder in the writing portion, but in order to further improve the ability to prevent ink leakage of the writing instrument of the present invention, in one embodiment of the invention, the buffer storage portion also wraps a portion of the nib in the writing portion.

In order to reasonably utilize resources as well as reduce waste, in one embodiment of the invention, the other end of the penholder is detachably provided with the ink storage portion. For example, the other end of the penholder is provided with the ink storage portion by snapping or screwing.

The beneficial effects of the present invention mainly lie in:

1. The direct-liquid writing instrument of the present invention is provided with an air-permeable and liquid-impermeable adjustable portion between the ink storage portion and the writing portion so as to block the ink in the ink storage portion from flowing to the writing portion and automatically balance the pressure in the ink storage portion. The first baffle and the second baffle are spaced to form an air barrier layer between the first baffle and the second baffle, and the first baffle is provided with the first air-guiding channel and the second air-guiding channel is provided between the second baffle and the ink feeder, wherein at least one gap is formed between the second air-guiding channel and the ink feeder. The ink leakage adjustment performance is improved and the design is unique and ingenious. Not only the capacity of ink is large, the amount of remaining ink is small, the writing is smooth and uniform, but also the instrument is not easy to leak ink even if the external temperature and pressure change largely, which is suitable for large-scale promotion and application.

2. The first air-guiding channel of the direct-liquid writing instrument of the invention extends into the air barrier layer, and the end of the first air-guiding channel, away from the first baffle, is tapered in diameter, which further improves the ink leakage adjustment performance. The design is unique and ingenious. Not only the capacity of ink is large, the amount of remaining ink is small, the writing is smooth and uniform, but also the instrument is not easy to leak ink even if the external temperature and pressure change largely, which is suitable for large-scale promotion and application.

3. The surface of the first baffle of the direct-liquid writing instrument of the invention toward the ink storage portion is provided with an ink-guiding groove along the direction toward the ink feeder. Therefore, when there is a little ink in the ink storage portion, the ink can easily penetrate into the ink feeder through the siphoning of the ink-guiding groove, thereby forming a continuous ink supply for the ink feeder. This structure is beneficial for using up the ink in the ink storage portion as much as possible, and the design is unique and ingenious. Not only the capacity of ink is large, the ink is not easily leaked, the writing is smooth and uniform, but also the amount of the remaining ink is largely reduced, which is suitable for large-scale promotion and application.

4. The direct-liquid writing instrument of the present invention is provided with an air-permeable and liquid-impermeable adjustable portion between the ink storage portion and the writing portion so as to block the ink in the ink storage portion from flowing to the writing portion and automatically balance the pressure in the ink storage portion. The first baffle and the second baffle are spaced to form an air barrier layer between the first baffle and the second baffle, and the first baffle is provided with the first air-guiding channel and the second air-guiding channel is provided between the second baffle and the ink feeder, which improves the ink leakage adjustment performance. The design is unique and ingenious and the structure is simple. Raw material is easily available and the production is simple, which is suitable for large-scale promotion and application.

5. The direct-liquid writing instrument of the present invention is provided with an air-permeable and liquid-impermeable adjustable portion between the ink storage portion and the writing portion so as to block the ink in the ink storage portion from flowing to the writing portion and automatically balance the pressure in the ink storage portion. The first baffle and the second baffle are spaced to form an air barrier layer between the first baffle and the second baffle, and the first baffle is provided with the first air-guiding channel and the second air-guiding channel is provided between the second baffle and the ink feeder, wherein at least one gap is formed between the second air-guiding channel and the ink feeder. The ink leakage adjustment performance is improved and the design is unique and ingenious. The structure is stable, resistant to differential pressure and temperature, and convenient to transport, which is suitable for large-scale promotion and application.

These and other objects, features and advantages of the present invention could be fully illustrated from the following detailed description, drawings, and claims, which are realized by the means, instrumentalities and their combinations particularly pointed out in the claims.

The following key can be used in connection with the present figures. Each element is discussed in greater detail with respect to the embodiments disclosed herein.

| | | | |
|---|---|---|---|
| 1 | penholder | 11 | writing portion |
| 12 | ink storage portion | 13 | ink |
| 2 | ink feeder | 3 | nib |
| 4 | adjusting portion | 41 | first baffle |
| 42 | second baffle | 43 | air barrier layer |
| 45 | convex rib | 46 | gap |
| 5 | buffer storage portion | 6 | ink-guiding groove |
| 61 | wedge-shaped groove | 62 | spiral groove |
| 7 | second air-guiding channel | 71 | second air-guiding hole |
| 72 | second air-guiding tube | 8 | first air-guiding channel |
| 81 | first air-guiding hole | 82 | first air-guiding tube |
| 10 | cap | | |

MODE OF CARRYING OUT THE INVENTION

In order to better understand the technical content of the present invention, the following specific embodiments are described in detail. It should be pointed out that all the diameters of the tubes mentioned here are internal diameters.

Embodiment 1

Figure 1A:
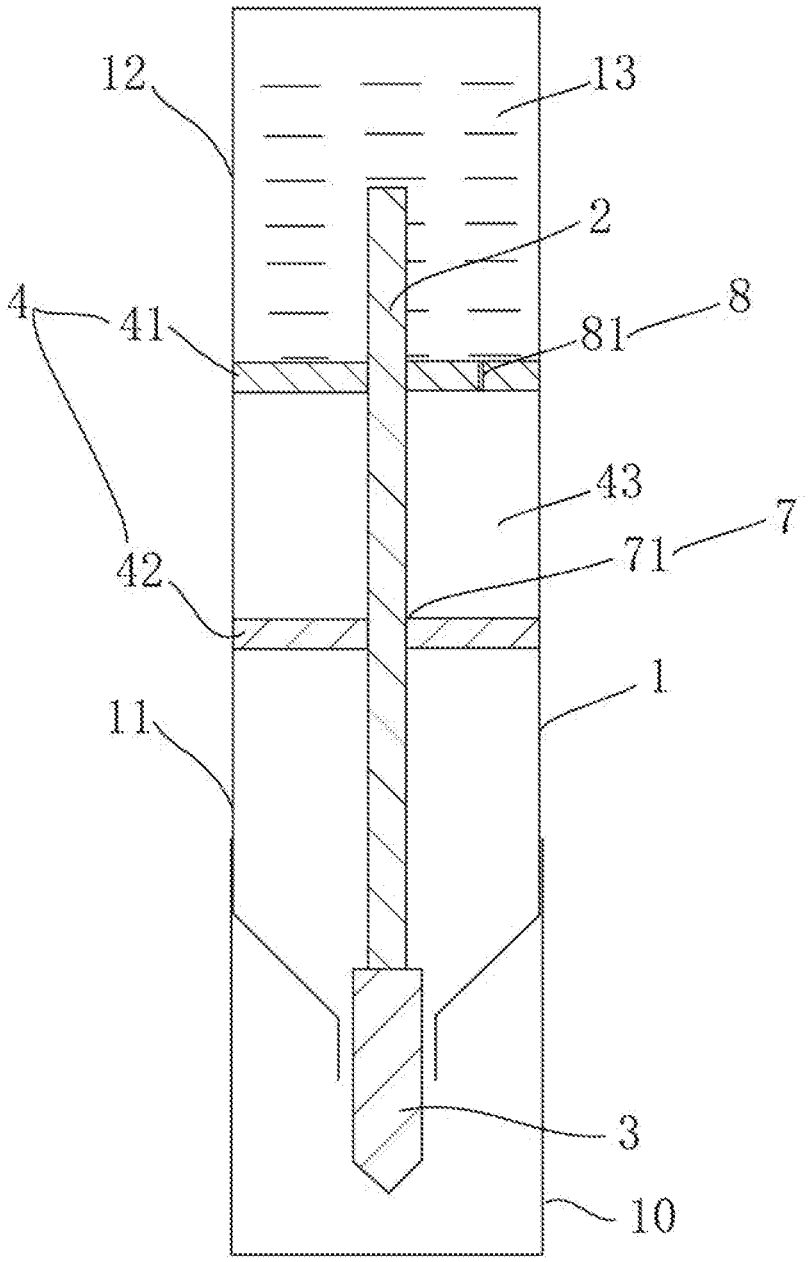
FIG. 1A is a cross-sectional front view of a first embodiment of the present invention.
Figure 1B:
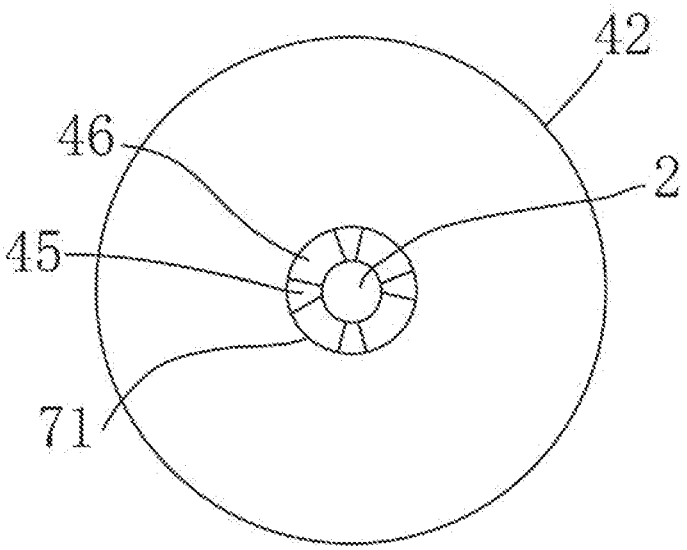
FIG. 1B is a cross-sectional top view of a second baffle, a second air-guiding hole, a convex rib, an ink feeder and a gap of the first specific embodiment of the present invention.

Please see FIG. 1A and FIG. 1B, in the first embodiment of the present invention, the direct-liquid writing instrument comprises a penholder 1, an ink feeder 2, a nib 3 and an adjusting portion 4, wherein the writing portion 11 is provided below the penholder 1 and part of the nib 3 is inserted in the writing portion 11. The cap 10 may further be provided. The cap 10 is sleeved on the writing portion 11, and the nib 3 is located in the cap 10. An ink storage portion 12 is provided on the upper part of the penholder 1, which is filled with ink 13. The adjusting portion 4 comprises a first baffle 41 and a second baffle 42. The ink feeder 2 passes through the first baffle 41 and the second baffle 42. The upper part of the ink feeder 2 is in contact with the ink 13 while the lower part of it is in contact with the upper part of the nib 3, thus forming an ink outlet channel. A stiffener is provided inside the lower part of the penholder 1 (not shown), and the nib 3 is clamped in the middle of the lower part of the penholder 1 equipped with the stiffener. The space left among the inside of the penholder 1, the stiffener and the nib 3 forms a channel communicating with the outside atmosphere (Certainly, the nib 3 and the writing portion 11 can be connected in a sealed mode, while holes are formed in other positions of the writing portion 11 for venting).

Figure 1C:
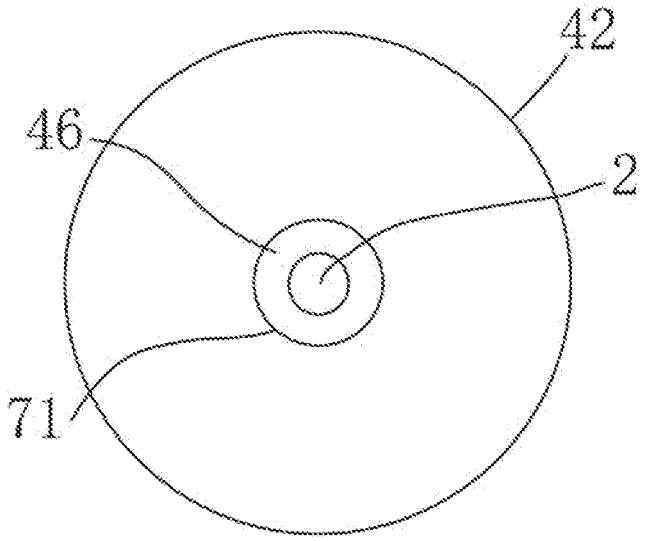
FIGS. 1C and 1D are cross-sectional top views of the second baffle, the second air-guiding hole, the convex rib, the ink feeder and the gap of other specific embodiments of the present invention.
Figure 1D:
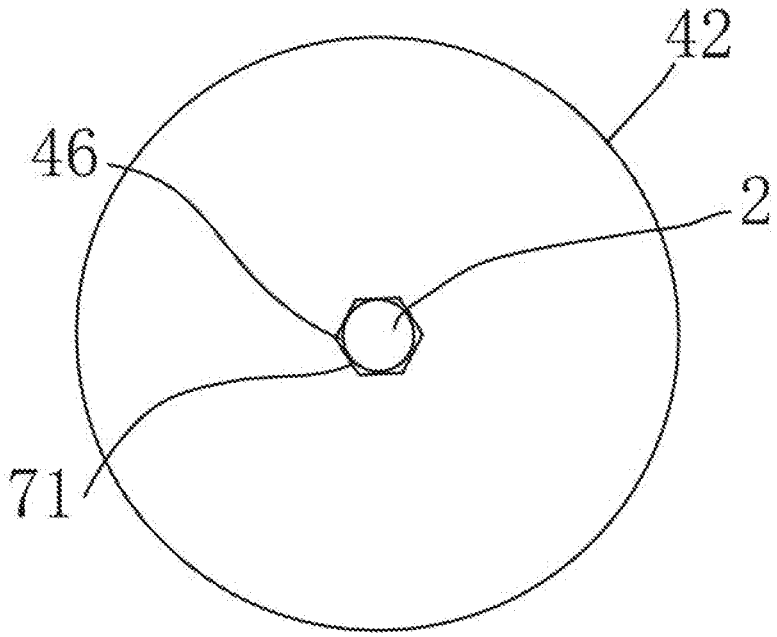

The first baffle 41 and the second baffle 42 are spaced apart so that an air barrier layer 43 is formed between the first baffle 41 and the second baffle 42. The first baffle 41 is in contact with the ink 13, and the second baffle 42 is adjacent to the writing portion 11. The first baffle 41 is provided with a first air-guiding channel 8. In the present embodiment, the first air-guiding channel 8 is a first air-guiding hole 81 without extending into the air barrier layer 43, so that the ink storage portion 12 is connected to the air barrier layer 43 through the first air-guiding hole 81. The second air-guiding channel 7 is provided between the second baffle 42 and the ink feeder 2, wherein the ink feeder 2 passes through the second air-guiding channel 7. In the present embodiment, the second air-guiding channel 7 is the second air-guiding hole 71. Specifically, the cross-section of the ink feeder is circular as well as the cross section of the air-guiding hole 71. Convex ribs 45 are provided in the air-guiding hole 71 and the convex ribs 45 abut against the ink feeder 2, so that four gaps 46 are formed between the ink feeder 2 and the second air-guiding hole 71. The four gaps are fan-shaped, as shown in FIG. 1B (or no convex rib 45 but annular convex rib 45 is provided, thus the gap 46 is a circular hole, as is shown in FIG. 1C; for another example, the cross section of the air-guiding hole 71 is hexagonal while the cross section of the ink feeder 2 is circular, wherein those two are in tangential state to form six gaps 46, as shown in FIG. 1D). The gap 46 has a width of 0.6 mm, a thickness of 0.02 mm, and a height of 0.2 mm. As a result, the air barrier layer 43 is connected to the writing portion 11 through the second air-guiding hole 71 (specifically, the gap 46). The diameter of the first air-guiding hole 81 is 0.5 mm, and the dimension of the adjusting portion 4 along the longitudinal direction of the penholder 1 is 2 mm (the dimensions of the first baffle 41 and the second baffle 42 along the longitudinal direction of the penholder 1 are both 0.2 mm), the diameter of the second air-guiding hole 71 is larger than that of the ink feeder 2 by 0.05 mm. The above-described adjusting portion 4 has a function of automatically balancing the ink and adjusting the pressure in the ink tube. In the initial state, the pressure in the ink storage portion 12 equals the outside, and the ink 13 in the ink storage portion 12 penetrates into the first air-guiding hole 81 to form a liquid seal. Therefore, the air outside cannot enter into the ink storage portion 12 freely. During the writing process, the ink 13 in the ink storage portion 12 is conducted to the nib 3 through the ink feeder 2. As the ink 13 is drawn out, the pressure in the ink storage portion 12 gradually decreases. When the negative pressure difference between the ink storage portion 12 and the outside is large enough, the differential pressure pushes the liquid seal up until the liquid seal is opened, the air entering into the ink storage portion 12 until the pressure inside and outside is rebalanced, and the liquid seal is re-formed in the first air-guiding hole 81. This process is repeated until the ink 13 is used up.

When the positive pressure difference between the ink storage portion 12 and the external environment is large, for example, when it is transported by air or when the ink storage portion 12 is heated, the ink 13 flows out from the ink storage portion 12, and a portion of the ink 13 flows into the air barrier layer 43 through the first air-guiding hole 81, and then it infiltrates into the gaps 46 of the second air-guiding hole 71 to form a liquid seal. Therefore, the ink 13 would not infiltrate out of the second baffle 42 to the writing portion 11 through the second air-guiding hole 71, while a portion of the ink 13 infiltrates through the ink feeder 2. However, since the total amount of the ink 13 derived through the two methods above is small, it does not leak towards outside through the nib 3. When the external environment returns to normal, the ink storage portion 12 forms a negative differential pressure from the outside. At this time, the ink 13 temporarily stored in the cavity of the adjusting portion 4, that is, the air barrier layer 43, the first air-guiding hole 81, and the second air-guiding hole 71 will partially return to the ink storage portion 12. The remaining ink 13 stored in the cavity of the adjusting portion 4 and the second air-guiding hole 71 is preferentially released to the nib 3 through the ink feeder 2 during writing process.

It should be noted that the gap 46 provided between the second air-guiding hole 71 and the ink feeder 2 further enhances the ability of the adjusting portion 4 to withstand the variations of the temperature and the pressure outside. Under the circumstance when a smaller gap 46 exists, a significantly large positive differential pressure between the inside of the ink storage portion 12 and the external environment is required for the ink 13 in the gap 46 with the liquid seal to enter into the writing portion 11. Therefore, the ability of the adjusting portion 4 to withstand variations of the temperature and the pressure outside is enhanced.

Embodiment 2

Figure 2A:
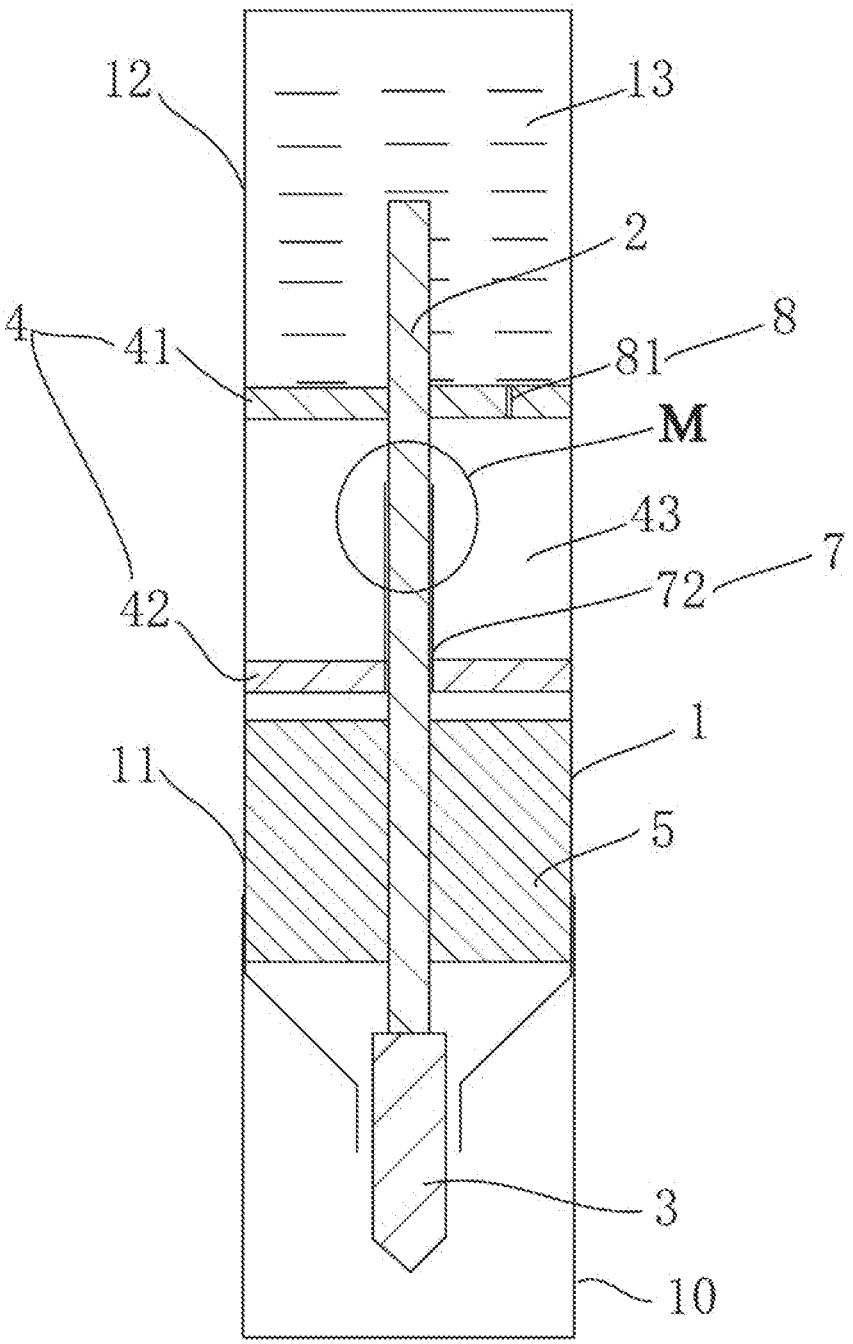
FIG. 2A is a cross-sectional front view of a second specific embodiment of the present invention.
Figure 2B:
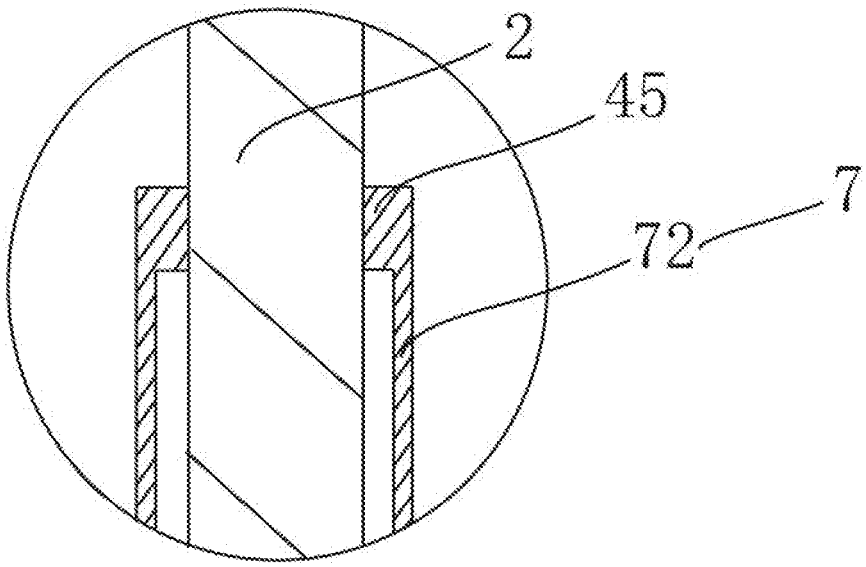
FIG. 2B is an enlarged cross-sectional view of region M in FIG. 2A.

Please see FIG. 2A and FIG. 2B, the structure and the working principle of Embodiment 2 are similar to those of Embodiment 1, except that:

The second air-guiding channel 7 is the second air-guiding tube 72. The second air-guiding tube 72 extends into the air barrier layer 43, and the dimension of it in the air barrier layer 43 extending along the longitudinal direction of the penholder 1 is 5 mm; the diameter of the first air-guiding hole 81 is 0.1 mm; the dimension of the adjusting portion 4 along the longitudinal direction of the penholder 1 is 10 mm (the dimensions of the first baffle 41 and the second baffle 42 along the longitudinal direction of the penholder 1 are both 1 mm); the diameter of the second air-guiding tube 72 is greater than that of the ink feeder 2 by 0.2 mm.

The cross section of the ink feeder 2 is circular as well as the cross section of the second air-guiding tube 72. The second air-guiding tube 72 is provided with convex ribs 45, wherein the convex ribs 45 abut against the ink feeder 2, so that five gaps 46 are provided between the ink feeder 2 and the second air-guiding tube 72. The gaps are fan-shaped, similar to that shown in FIG. 1B, but the number of the convex ribs 45 is more (or no convex ribs 45 but annular convex rib 45 is provided, thus the gap 46 is an annular hole, similar to that shown in FIG. 1C; for another example, the cross section of the second air-guiding tube 72 is hexagonal while that of the ink feeder 2 is circular, and the two are tangent to form six gaps 46, similar to that shown in FIG. 1D). The gap 46 has a width of 0.8 mm, a thickness of 0.04 mm, and a height of 1 mm. The gaps 46 are formed at the end of the second air-guiding tube 72 adjacent to the first baffle 41, as shown in FIG. 2B.

In addition, the buffer storage portion 5 is provided in the writing portion 11 and wraps a portion of the ink feeder 2 in the writing portion 11. The buffer storage portion 5 may be a porous structure absorbing ink, wherein the pores form an air channel connecting the adjusting portion 4 to the external atmosphere. Of course, other configurations may also be adopted to enable the buffer storage portion 5 to connect to the adjusting portion 4 and the external atmosphere. For example, a micro pore which air can pass through is provided between the buffer storage portion 5 and the outer wall of the ink feeder 2 or the inner wall of the penholder 1.

In the initial state, the pressure in the ink storage portion 12 equals the pressure outside, and the ink 13 in the ink storage portion 12 penetrates into the first air-guiding hole 81 to form a liquid seal. Therefore, the air outside cannot enter into the ink storage portion 12 freely. During the writing process, the ink 13 in the ink storage portion 12 is conducted to the nib 3 through the ink feeder 2. As the ink 13 is drawn out, the pressure in the ink storage portion 12 gradually decreases. When the negative pressure difference between the ink storage portion 12 and the outside is large enough, the differential pressure pushes the liquid seal up until the liquid seal is opened, the air entering into the ink storage portion 12 until the pressure inside and outside is rebalanced, and the liquid seal is re-formed in the first air-guiding hole 81. This process is repeated until the ink 13 is used up.

When the positive pressure difference between the ink storage portion 12 and the external environment is large, for example, when it is transported by air or when the ink storage portion 12 is heated, the ink 13 flows out from the ink storage portion 12, and a portion of the ink 13 flows into the air barrier layer 43 through the first air-guiding hole 81, then it infiltrates into the gaps 46 of the second air-guiding tube 72 to form a liquid seal. Therefore, the ink 13 would not infiltrate out of the second baffle 42 to the writing portion 11 through the second air-guiding tube 72, while a portion of the ink 13 infiltrates through the ink feeder 2 and the excess ink 13 is formed at the lower part of the ink feeder 2. At this time, the buffer storage portion 5 absorbs the excess ink 13 at the lower of the ink feeder 2 to prevent the excess ink 13 from leaking to the outside through the nib 3. When the external environment returns to normal, the ink storage portion 12 forms a negative differential pressure to the outside. At this time, the ink 13 temporarily stored in the cavity of the adjusting portion 4, that is, the air barrier layer 43, the first air-guiding hole 81, and the second air-guiding tube 72 will partially return to the ink storage portion 12. The remaining ink 13 stored in the cavity of the adjusting portion 4, the second air-guiding tube 72 and the buffer storage portion 5 is preferentially released to the nib 3 through the ink feeder 2 during the writing process.

It should be noted that the second air-guiding tube 72 extending into the air barrier layer 43 helps improve the ability of the adjusting portion 4 to withstand the variations of the temperature and the pressure outside. Since such air-guiding tube 72 is provided, the ink 13 will not infiltrate into the second air-guiding tube 72 at all when the ink 13 introduces into the air barrier layer 43 from the first air-guiding hole 81 is less. Only when there is quite lots of ink 13 will it infiltrate into the second air-guiding tube 72, but it will form a liquid seal so that the ability of the adjusting portion 4 to withstand the variations of the temperature and the pressure outside is enhanced.

Embodiment 3

Figure 3:
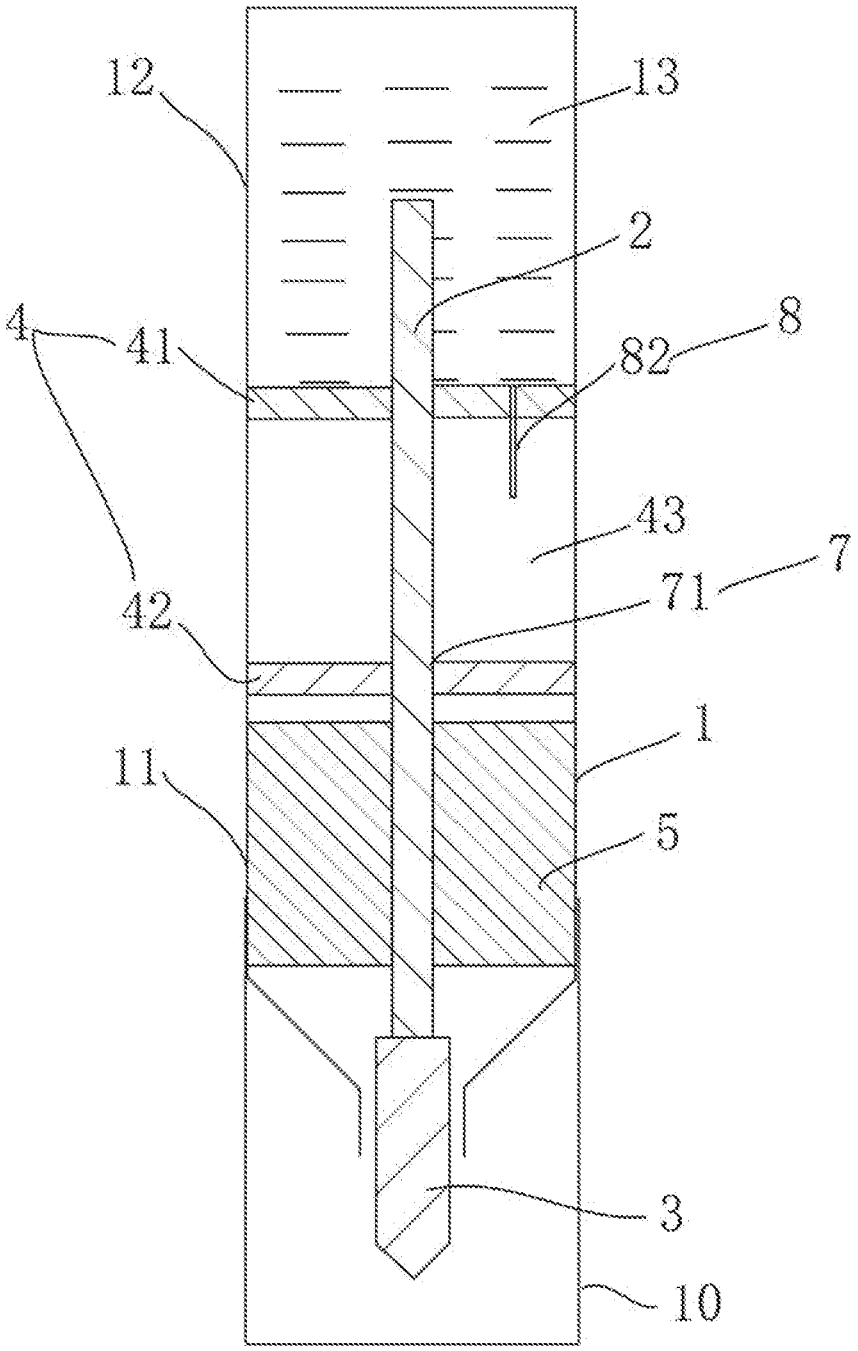
FIG. 3 is a cross-sectional front view of a third specific embodiment of the present invention.

Please see FIG. 3, the structure and the working principle of Embodiment 3 of the present invention are similar to those of Embodiment 1, except that:

The first air-guiding channel 8 is a first air-guiding tube 82. The first air-guiding tube 82 extends into the air barrier layer 43 and the dimension of it in the air barrier layer 43 extending along the longitudinal direction of the penholder 1 is 5 mm; the diameter of the first air-guiding tube 82 is 0.5 mm; the dimension of the adjusting portion 4 along the longitudinal direction of the penholder 1 is 20 mm (the dimensions of the first baffle 41 and the second baffle 42 along the longitudinal direction of the penholder 1 are both 1 mm); the diameter of the second air-guiding hole 71 is greater than that of the ink feeder 2 by 0.4 mm.

The cross section of the ink feeder 2 is circular, so as the second air-guiding hole 71. Convex ribs 45 are provided in the second air-guiding hole 71. The convex ribs 45 abut against the ink feeder 2 so that five gaps 46 are provided between the ink feeder 2 and the second air-guiding hole 71, which are fan-shaped, similar to that shown in FIG. 1B, but with a larger number of convex ribs 45. (Or no convex rib 45 but annular convex rib 45 is provided, and the gap 46 is an annular hole, as shown in FIG. 1C. For another example, the cross section of the second air-guiding hole 71 is hexagonal while the cross section of the ink feeder 2 is circular, and the two are tangent to form six gaps 46 as shown in FIG. 1D). The gap 46 has a width of 0.4 mm, a thickness of 0.1 mm and a height of 0.5 mm. The gaps 46 are disposed at the end of the second air-guiding hole 71 adjacent to the first baffle 41, that is, the upper half of the second air-guiding hole 71.

In addition, the buffer storage portion 5 is provided in the writing portion 11 and wraps a part of the ink feeder 2 in the writing portion 11. The buffer storage portion 5 may be a porous ink-adsorption structure, wherein the pore structure constitutes an air passage connecting the adjusting portion 4 to the external atmosphere. Of course, other structural arrangements may also be adopted to enable the buffer storage portion 5 to connect to the adjusting portion 4 and the outside atmosphere. For example, a micro pore for air to pass through is provided between the buffer storage portion 5 and the outer wall of the ink feeder 2 or the inner wall of the penholder 1.

In the initial state, the pressure in the ink storage portion 12 coincides with the external environment. The ink 13 in the ink storage portion 12 infiltrates into the first air-guiding tube 82 to form a liquid seal, and the outside air cannot be freely introduced into the ink storage portion 12. During the writing process, the ink 13 in the ink storage portion 12 is conducted to the nib 3 through the ink feeder 2. As the ink 13 is led out, the pressure inside the ink storage portion 12 gradually decreases. When the negative pressure between the ink storage portion 12 and outside is large enough, the differential pressure pushes the liquid seal up until the liquid seal is opened and the air enters the ink storage portion 12 until the inside and the outside rebalance, and the liquid seal is re-formed in the first air-guiding tube 82. This process is repeated until the ink 13 is used up.

When a large positive differential pressure is formed between the ink storage portion 12 and the external environment, for example, when it is transported by air or when the ink storage portion 12 is heated, the ink 13 is discharged from the ink storage portion 12 and a portion of ink 13 is led out into the air barrier layer 43 through the first air-guiding tube 82, and then penetrates into the gaps 46 of the second air-guiding hole 71 to form a liquid seal. Therefore, the ink 13 would not infiltrate out of the second baffle 42 to the writing portion 11 through the second air-guiding hole 71, while a portion of the ink 13 infiltrates through the ink feeder 2 and the excess ink 13 is formed at the lower part of the ink feeder 2. At this time, the buffer storage portion 5 absorbs the excess ink 13 at the lower part of the ink feeder 2 to prevent the excess ink 13 from leaking to the outside through the nib 3. When the external environment returns to normal, the ink storage portion 12 forms a negative differential pressure to the outside. At this time, the ink 13 temporarily stored in the cavity of the adjusting portion 4, that is, the air barrier layer 43, the first air-guiding tube 82, the second air-guiding hole 71, and the buffer storage portion 5, will partially return to the ink storage portion 12. During the writing process, the remaining ink 13 stored in the cavity of the adjusting portion 4, the second air-guiding hole 71 and the buffer storage portion 5 will be preferentially released to the nib 3 through the ink feeder 2.

It should be noted that the first air-guiding tube 82 extending into the air barrier layer 43 helps improve the ability of the adjusting portion 4 to resist variations in temperature and pressure outside. Since such first air-guiding tube 82 is provided, when the positive differential pressure with the external environment is not large enough, the ink 13 moves downward in the first air-guiding tube 82, but cannot flow out of the first air-guiding tube 82 to enter into the air barrier layer 43. Only when the positive differential pressure between the external environment and the ink storage portion 12 is large enough will the ink 13 flow out of the first air-guiding tube 82 and enters into the air barrier layer 43, so as to improve the capability of the adjusting portion 4 to resist the external temperature and pressure variations.

Embodiment 4

Figure 4:
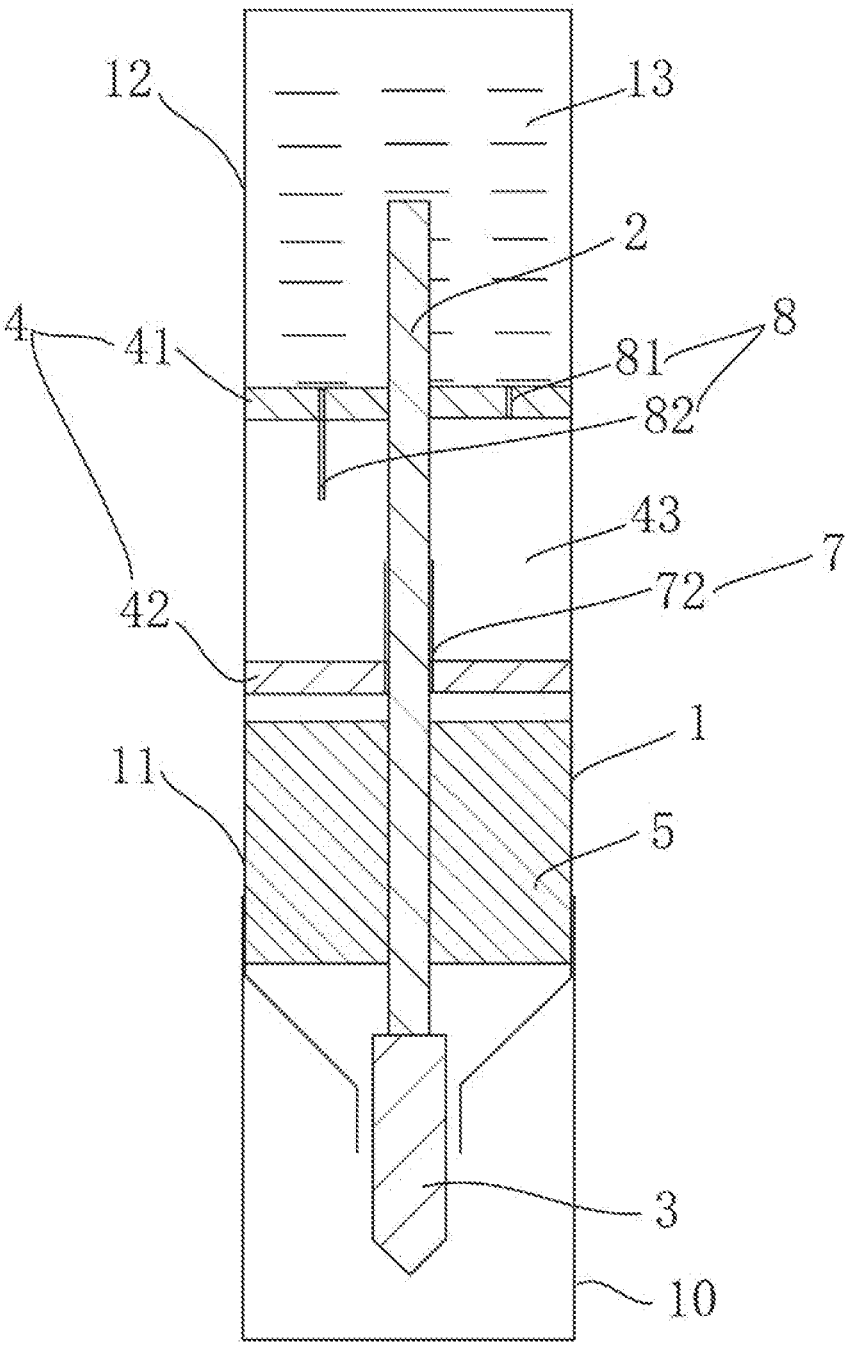
FIG. 4 is a cross-sectional front view of a forth specific embodiment of the present invention.

Please see FIG. 4, the structure and the working principle of Embodiment 4 of the present invention are similar to those of Embodiment 2, except that:

The first air-guiding channel 8 is a combination of the first air-guiding hole 81 and the first air-guiding tube 82. The first air-guiding tube 82 extends into the air barrier layer 43, and the dimension of it in the air barrier layer 43 extending along the longitudinal direction of the penholder 1 is 10 mm; the length of the second air-guiding tube 72 in the air barrier layer 43 extending in the longitudinal direction of the penholder 1 is 10 mm; the diameter of the first air-guiding hole 81 is 0.5 mm; the diameter of the first air-guiding tube 82 is 1 mm; the dimension of the adjusting portion 4 along the longitudinal direction of the penholder 1 is 30 mm (the dimensions of the first baffle 41 and the second baffle 42 along the longitudinal direction of the penholder 1 are both 1 mm); the diameter of the second air-guiding tube 72 is 0.8 mm larger than the diameter of the ink feeder 2.

The cross section of the ink feeder 2 is circular, so as the second air-guiding tube 72. Convex ribs 45 are provided in the second air-guiding tube 72. The convex ribs 45 abut against the ink feeder 2 so that four gaps 46 are provided between the ink feeder 2 and the second air-guiding tube 72, which are fan-shaped, similar to that shown in FIG. 1B (Or no convex rib 45 but annular convex rib 45 is provided, and the gap 46 is an annular hole, as shown in FIG. 1C. For another example, the cross section of the second air-guiding tube 72 is hexagonal while the cross section of the ink feeder 2 is circular, and the two are tangent to form six gaps 46 as shown in FIG. 1D). The gap 46 has a width of 0.5 mm, a thickness of 0.08 mm and a height of 0.1 mm. The gaps 46 are disposed at the middle part of the second air-guiding tube 72.

In the initial state, the pressure in the ink storage portion 12 equals the pressure outside, and the ink 13 in the ink storage portion 12 penetrates into the first air-guiding hole 81 and the first air-guiding tube 82 to form a liquid seal. Therefore, the air outside cannot enter into the ink storage portion 12 freely. During the writing process, the ink 13 in the ink storage portion 12 is conducted to the nib 3 through the ink feeder 2. As the ink 13 is drawn out, the pressure in the ink storage portion 12 gradually decreases. When the negative pressure difference between the ink storage portion 12 and the outside is large enough, the differential pressure pushes the liquid seal up until the liquid seal is opened, the air entering into the ink storage portion 12 until the pressure inside and outside is rebalanced, and the liquid seal is re-formed in the first air-guiding hole 81 and the first air-guiding tube 82. This process is repeated until the ink 13 is used up.

When there is a large positive differential pressure between the ink storage portion 12 and the external environment, for example, when it is transported by air or when the ink storage portion 12 is heated, the ink 13 is led out of the ink storage portion 12, and a part of the ink 13 is led out into the air barrier layer 43 through the first air-guiding hole 81. If the positive differential pressure is greater, the ink 13 will further be led out from the first air-guiding tube 82 into the air barrier layer 43, then penetrates into the second air-guiding tube 72 (even the gap 46) to form a liquid seal. Therefore, the ink 13 will not permeate out of the second baffle 42 to enter into the writing portion 11, while a part of the ink 13 infiltrates through the ink feeder 2 and the excess ink 13 is formed at the lower part of the ink feeder 2. At this time, the buffer storage portion 5 absorbs the excess ink 13 at the lower part of the ink feeder 2 to prevent from leaking outside through the nib 3. When the external environment returns to normal, the ink storage portion 12 forms a negative differential pressure to the outside. At this time, the ink 13 is temporarily stored in the cavity of the adjusting portion 4, that is, the air barrier layer 43, the first air-guiding hole 81, the first air-guiding tube 82, the second air-guiding tube 72 and the buffer storage portion 5, will partially return to the ink storage portion 12. During the writing process, the remaining ink 13 stored in the cavity of the adjusting portion 4, the second air-guiding tube 72 and the buffer storage portion 5 will be preferentially released to the nib 3 through the ink feeder 2.

It should be noted that the first air-guiding tube 82 and the second air-guiding tube 72 that extend into the air barrier layer 43 help to improve the ability of the adjusting portion 4 to withstand changes in temperature and pressure outside. Due to the first air-guiding tube 82, when a positive differential pressure between the ink storage portion 12 and the external environment is not large enough, the ink 13 moves downward in the first air-guiding tube 82 but fails to flow out of first air-guiding tube 82 to enter into the air barrier layer 43. Only when the positive differential pressure between the inside of the ink storage portion 12 and the external environment is large enough will the ink 13 flow out of the first air-guiding tube 82 to enter into the air barrier layer 43. Since such second air-guiding tube 72 is provided, the ink 13 will not infiltrate into the second air-guiding tube 72 at all when there is only a small amount of ink 13 in the air barrier layer 43. Only when the amount of the ink 13 is large enough will the ink 13 penetrate into the second air-guiding tube 72, but a liquid seal will be formed so as to improve the ability of the adjusting portion 4 to resist the changes of the external temperature and pressure.

Furthermore, the gap 46 provided between the second air-guiding tube 72 and the ink feeder 2 further enhances the ability of the adjusting portion 4 to withstand the changes in temperature and pressure outside. In the presence of a smaller gap 46, a significantly large positive differential pressure between the inside of the ink storage portion 12 and the external environment is required for the ink in the gap 46 with the liquid seal to enter into the writing portion 11. Therefore, the ability of the adjusting portion 4 to withstand variations of the temperature and the pressure outside is enhanced.

Embodiment 5

Figure 5:
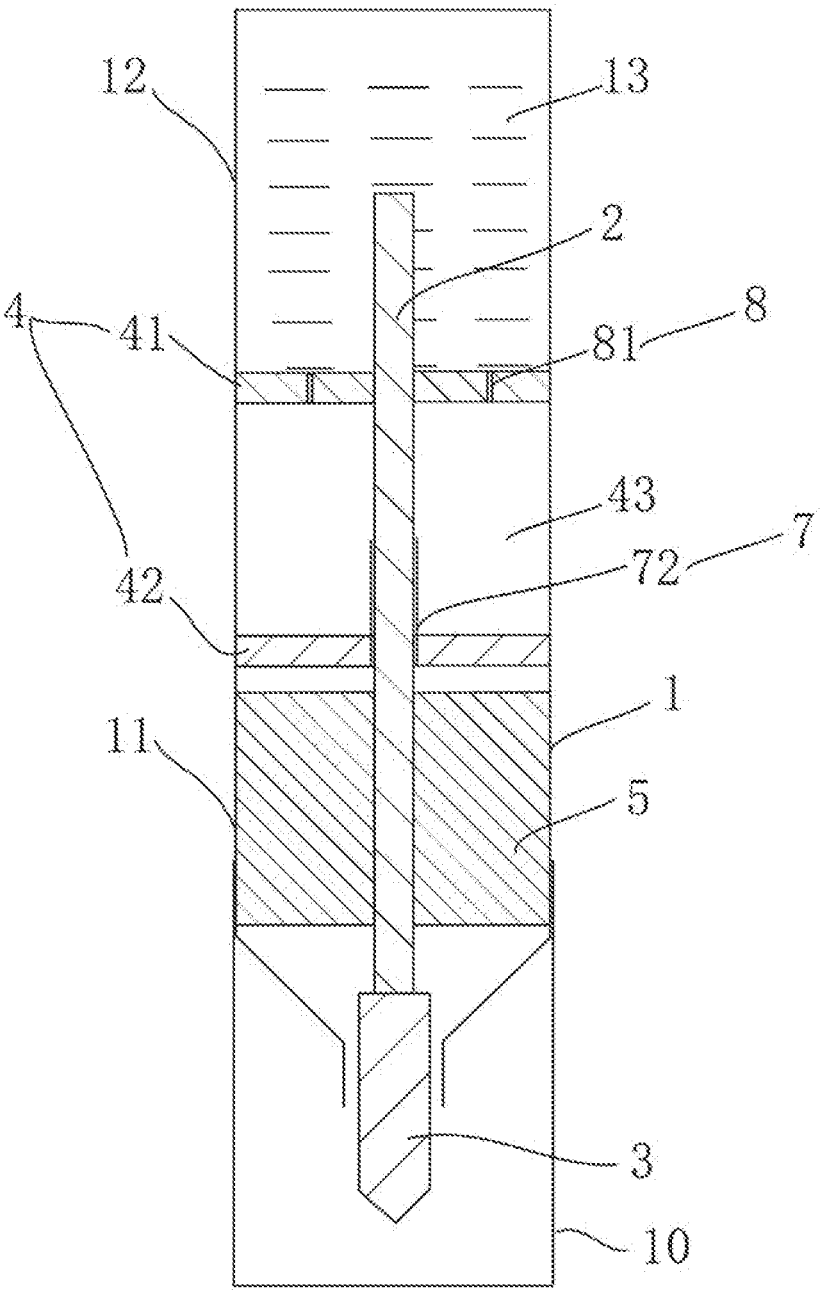
FIG. 5 is a cross-sectional front view of a fifth specific embodiment of the present invention.

Please see FIG. 5, the structure and the working principle of Embodiment 5 of the present invention are similar to those of Embodiment 2, except that:

The first air-guiding channel 8 is a first air-guiding hole 81, wherein the number of the first air-guiding holes 81 is two and the two holes are set apart from each other. The second air-guiding tube 72 extends into the air barrier layer 43 and the dimension of it in the air barrier layer 43 extending along the longitudinal direction of the penholder 1 is 20 mm; the diameter of the first air-guiding hole 81 is 0.2 mm; the dimension of the adjusting portion 4 along the longitudinal direction of the penholder 1 is 50 mm (the dimensions of the first baffle 41 and the second baffle 42 along the longitudinal direction of the penholder 1 are both 1 mm); the diameter of the second air-guiding tube 72 is greater than that of the ink feeder 2 by 2 mm.

No convex rib 45 is provided (or annular convex rib 45 is provided) between the second air-guiding tube 72 and the ink feeder 2, thus the gap 46 is an annular hole, similar to that shown in FIG. 1C (of course, convex ribs 45 can also be provided at intervals between the second air-guiding tube 72 and the ink feeder 2, the shape of the gap 46 is similar to that shown in 1B, and may also be similar to that shown in 1D). The gap 46 has a width of 3 mm, a thickness of 0.02 mm and a height of 1 mm. The gap 46 is provided at the second air-guiding tube 72 close to the second baffle 42.

In the initial state, the pressure in the ink storage portion 12 equals the pressure outside, and the ink 13 in the ink storage portion 12 penetrates into the first air-guiding hole 81 to form a liquid seal. Therefore, the air outside cannot enter into the ink storage portion 12 freely. During the writing process, the ink 13 in the ink storage portion 12 is conducted to the nib 3 through the ink feeder 2. As the ink 13 is drawn out, the pressure in the ink storage portion 12 gradually decreases. When the negative pressure difference between the ink storage portion 12 and the outside is large enough, the differential pressure pushes the liquid seal up until the liquid seal is opened, the air entering into the ink storage portion 12 until the pressure inside and outside is rebalanced, and the liquid seal is re-formed in the first air-guiding hole 81. This process is repeated until the ink 13 is used up.

When the positive pressure difference between the ink storage portion 12 and the external environment is large, for example, when it is transported by air or when the ink storage portion 12 is heated, the ink 13 flows out from the ink storage portion 12, and a portion of the ink 13 flows into the air barrier layer 43 through the first air-guiding hole 81, then it infiltrates into the second air-guiding tube 72 (even the gap 46) to form a liquid seal. Therefore, the ink 13 would not infiltrate out of the second baffle 42 to enter into the writing portion 11 through the second air-guiding tube 72, while a portion of the ink 13 infiltrates through the ink feeder 2 and the excess ink 13 is formed at the lower part of the ink feeder 2. At this time, the buffer storage portion 5 absorbs the excess ink 13 at the lower of the ink feeder 2 to prevent the excess ink 13 from leaking outside through the nib 3. When the external environment returns to normal, the ink storage portion 12 forms a negative differential pressure to the outside. At this time, the ink 13 temporarily stored in the cavity of the adjusting portion 4, that is, the air barrier layer 43, the first air-guiding hole 81, the second air-guiding tube 72 and the buffer storage portion 5, will partially return to the ink storage portion 12. The remaining ink 13 stored in the cavity of the adjusting portion 4, the second air-guiding tube 72, and the buffer storage portion 5 is preferentially released to the nib 3 through the ink feeder 2 during the writing process.

Embodiment 6

Figure 6:
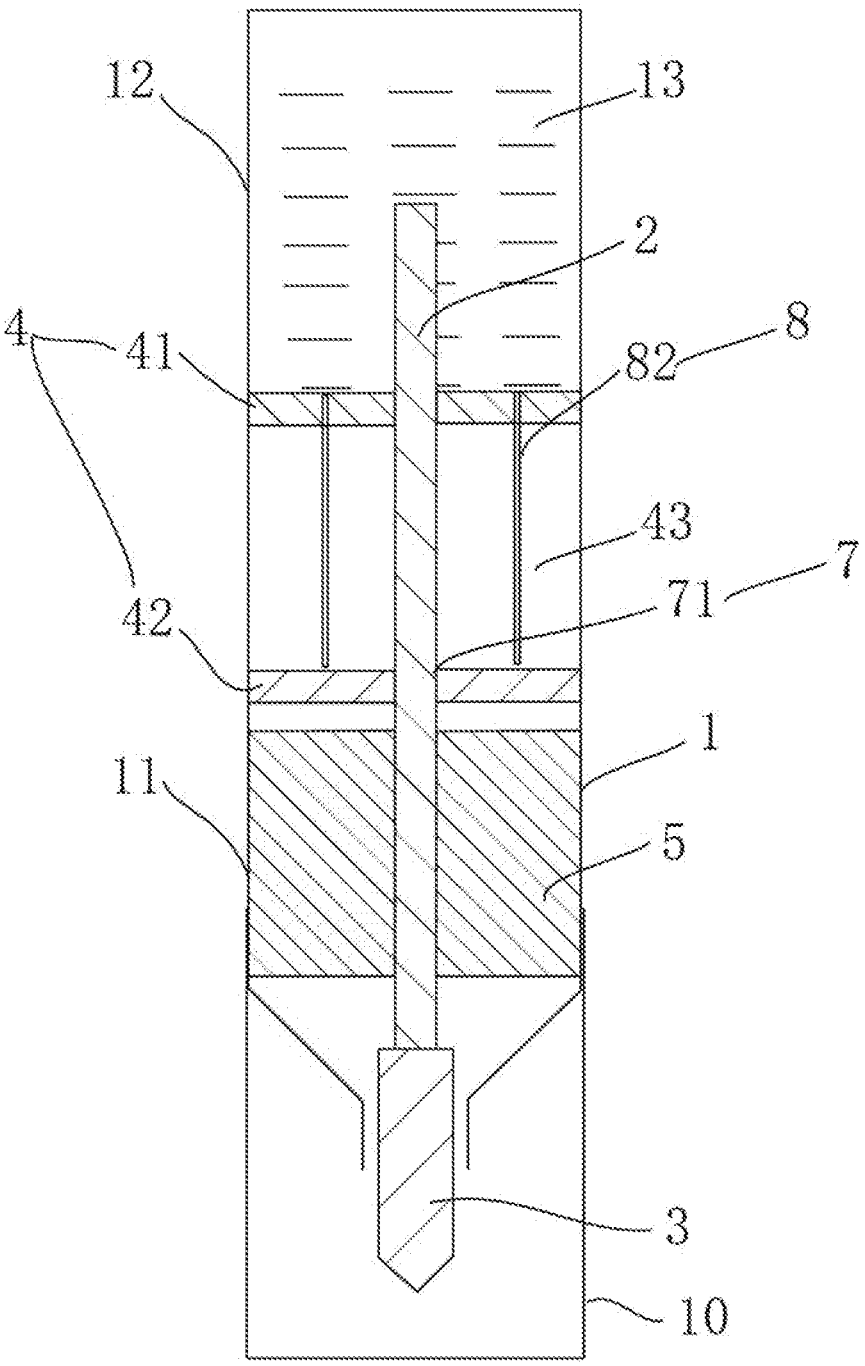
FIG. 6 is a cross-sectional front view of a sixth specific embodiment of the present invention.

Please see FIG. 6, the structure and the working principle of Embodiment 6 of the present invention are similar to those of Embodiment 3, except that:

The number of the first air-guiding tubes 82 is two, which are set apart from each other. The dimension of first air-guiding tube 82 in the air barrier layer 43 extending along the longitudinal direction of the penholder 1 is 30 mm, which equals to the value of the dimension of the air barrier layer 43 along the longitudinal direction of the penholder 1; the diameter of the first air-guiding tube 82 is 3 mm; the dimension of the adjusting portion 4 along the longitudinal direction of the penholder 1 is 32 mm (the dimensions of the first baffle 41 and the second baffle 42 along the longitudinal direction of the penholder 1 are both 1 mm); the diameter of the second air-guiding hole 71 is greater than that of the ink feeder 2 by 0.6 mm.

The cross section of the ink feeder 2 is circular, so as the second air-guiding hole 71. Convex ribs 45 are provided in the second air-guiding hole 71. The convex ribs 45 abut against the ink feeder 2 so that four gaps 46 are provided between the ink feeder 2 and the second air-guiding hole 71, which are fan-shaped, similar to that shown in FIG. 1B (or no convex ribs 45 but annular convex rib 45 is provided, thus the gap 46 is an annular hole, similar to that shown in FIG. 1C; for another example, the cross section of the second air-guiding hole 71 is hexagonal while that of the ink feeder 2 is circular, and the two are tangent to form six gaps 46, similar to that shown in FIG. 1D). The gap 46 has a width of 0.6 mm, a thickness of 0.1 mm, and a height of 0.5 mm. The gap 46 is formed at the end of the second air-guiding hole 71 adjacent to the first baffle 41, that is, the lower half part of the second air-guiding hole 71.

In the initial state, the pressure in the ink storage portion 12 equals the pressure outside, and the ink 13 in the ink storage portion 12 penetrates into the first air-guiding tube 82 to form a liquid seal. Therefore, the air outside cannot enter into the ink storage portion 12 freely. During the writing process, the ink 13 in the ink storage portion 12 is conducted to the nib 3 through the ink feeder 2. As the ink 13 is drawn out, the pressure in the ink storage portion 12 gradually decreases. When the negative pressure difference between the ink storage portion 12 and the outside is large enough, the differential pressure pushes the liquid seal up until the liquid seal is opened, the air entering into the ink storage portion 12 until the pressure inside and outside is rebalanced, and the liquid seal is re-formed in the first air-guiding tube 82. This process is repeated until the ink 13 is used up.

When the positive pressure difference between the ink storage portion 12 and the external environment is large, for example, when it is transported by air or when the ink storage portion 12 is heated, the ink 13 flows out from the ink storage portion 12, and a portion of the ink 13 flows into the air barrier layer 43 through the first air-guiding tube 82, then it infiltrates into the second air-guiding hole 71 (even the gaps 46) to form a liquid seal. Therefore, the ink 13 would not infiltrate out of the second baffle 42 to the writing portion 11 through the second air-guiding hole 71, while a portion of the ink 13 infiltrates through the ink feeder 2 and the excess ink 13 is formed at the lower part of the ink feeder 2. At this time, the buffer storage portion 5 absorbs the excess ink 13 at the lower of the ink feeder 2 to prevent the excess ink 13 from leaking to the outside through the nib 3. When the external environment returns to normal, the ink storage portion 12 forms a negative differential pressure to the outside. At this time, the ink 13 temporarily stored in the cavity of the adjusting portion 4, that is, the air barrier layer 43, the first air-guiding tube 82, the second air-guiding hole 71, and the buffer storage portion 5, will partially return to the ink storage portion 12. The remaining ink 13 stored in the cavity of the adjusting portion 4, the second air-guiding hole 71, and the buffer storage portion 5 is preferentially released to the nib 3 through the ink feeder 2 during the writing process.

Embodiment 7

Figure 7:
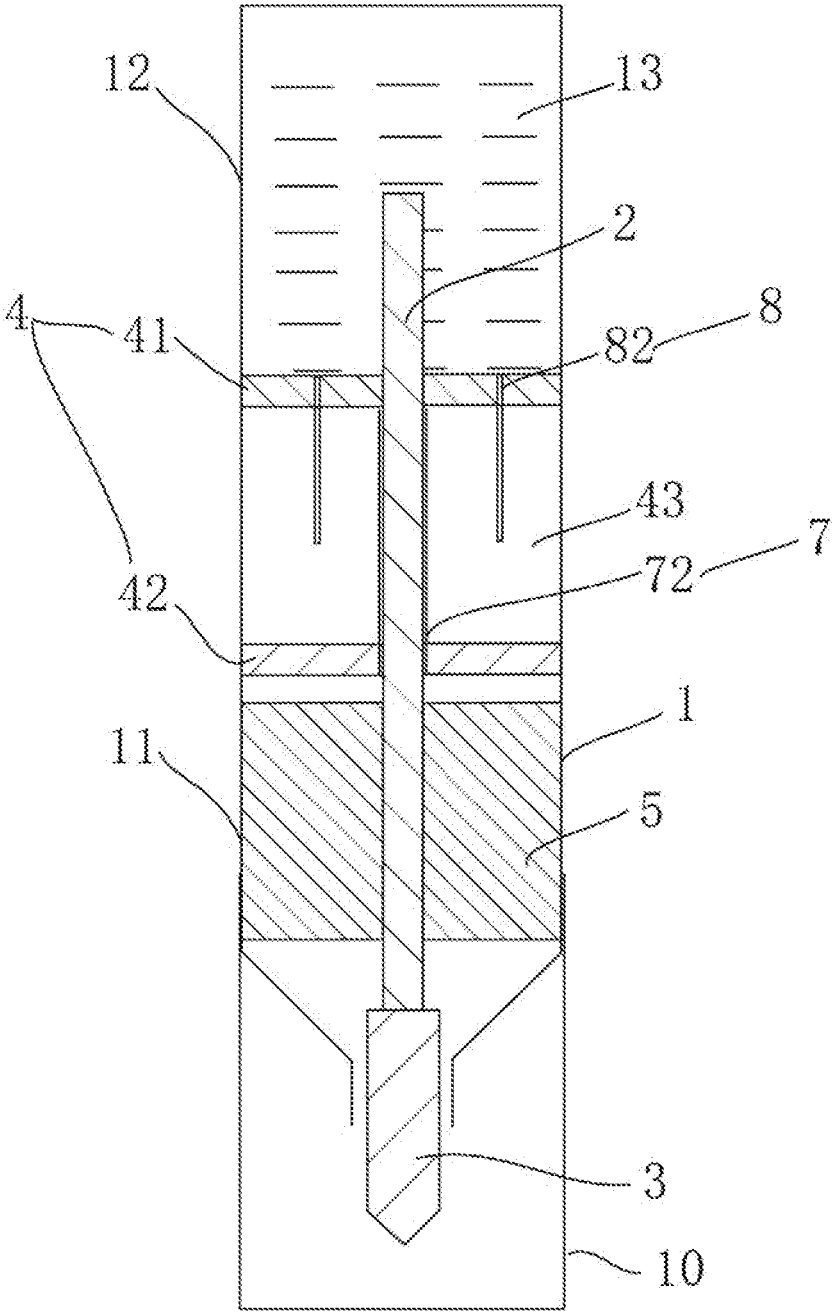
FIG. 7 is a cross-sectional front view of a seventh specific embodiment of the present invention.

Please see FIG. 7, the structure and the working principle of Embodiment 7 of the present invention are similar to those of Embodiment 2, except that:

The first air-guiding channel 8 is a first air-guiding tube 82, wherein the number of the first air-guiding tubes 82 is two. The dimension of the first air-guiding tube 82 in the air barrier layer 43 extending along the longitudinal direction of the penholder 1 is 20 mm; the dimension of the second air-guiding tube 72 in the air barrier layer 43 extending along the longitudinal direction of the penholder 1 is 36 mm, a value of the dimension of the air barrier layer 43 along the longitudinal direction of the penholder 1; the diameter of the first air-guiding tube 82 is 1.5 mm; the dimension of the adjusting portion 4 along the longitudinal direction of the penholder 1 is 38 mm (the dimensions of the first baffle 41 and the second baffle 42 along the longitudinal direction of the penholder1 are both 1 mm); the diameter of the second air-guiding tube 72 is greater than that of the ink feeder 2 by 0.5 mm.

The cross section of the second air-guiding tube 72 is hexagon, while the cross section of the ink feeder 2 is circular. The two are tangent to form six gaps 46, similar to that shown in FIG. 1D (of course, convex rib 45 can also be provided at intervals between the second air-guiding tube 72 and the ink feeder 2, and the shape of the gaps 46 is similar to that shown in FIG. 1B; or no convex ribs 45 but an annular convex rib 45 is provided, thus the gap 46 is an annular hole, as shown in FIG. 1C). The gap 46 has a width of 0.3 mm, a thickness of 0.1 mm and a height of 2 mm. The gaps 46 are disposed at the end of the second air-guiding tube 72 close to the end of the first baffle 41.

In the initial state, the pressure in the ink storage portion 12 equals the pressure outside, and the ink 13 in the ink storage portion 12 penetrates into the first air-guiding tube 82 to form a liquid seal. Therefore, the air outside cannot enter into the ink storage portion 12 freely. During the writing process, the ink 13 in the ink storage portion 12 is conducted to the nib 3 through the ink feeder 2. As the ink 13 is drawn out, the pressure in the ink storage portion 12 gradually decreases. When the negative pressure difference between the ink storage portion 12 and the outside is large enough, the differential pressure pushes the liquid seal up until the liquid seal is opened, the air entering into the ink storage portion 12 until the pressure inside and outside is rebalanced, and the liquid seal is re-formed in the first air-guiding tube 82. This process is repeated until the ink 13 is used up.

When the positive pressure difference between the ink storage portion 12 and the external environment is relatively large, for example, when it is transported by air or when the ink storage portion 12 is heated, the ink 13 flows out from the ink storage portion 12, and a portion of the ink 13 flows into the air barrier layer 43 through the first air-guiding tube 82, then it infiltrates into the gap 46 of the second air-guiding tube 72 to form a liquid seal. Therefore, the ink 13 would not infiltrate out of the second baffle 42 to enter into the writing portion 11, while a portion of the ink 13 infiltrates through the ink feeder 2 and the excess ink 13 is formed at the lower part of the ink feeder 2. At this time, the buffer storage portion 5 absorbs the excess ink 13 at the lower of the ink feeder 2 to prevent the excess ink 13 from leaking outside through the nib 3. When the external environment returns to normal, the ink storage portion 12 forms a negative differential pressure to the outside. At this time, the ink 13 temporarily stored in the cavity of the adjusting portion 4, that is, the air barrier layer 43, the first air-guiding tube 82, the second air-guiding tube 72, and the buffer storage portion 5, will partially return to the ink storage portion 12. The remaining ink 13 stored in the cavity of the adjusting portion 4, the second air-guiding tube 72, and the buffer storage portion 5 is preferentially released to the nib 3 through the ink feeder 2 during the writing process.

Embodiment 8

Figure 8A:
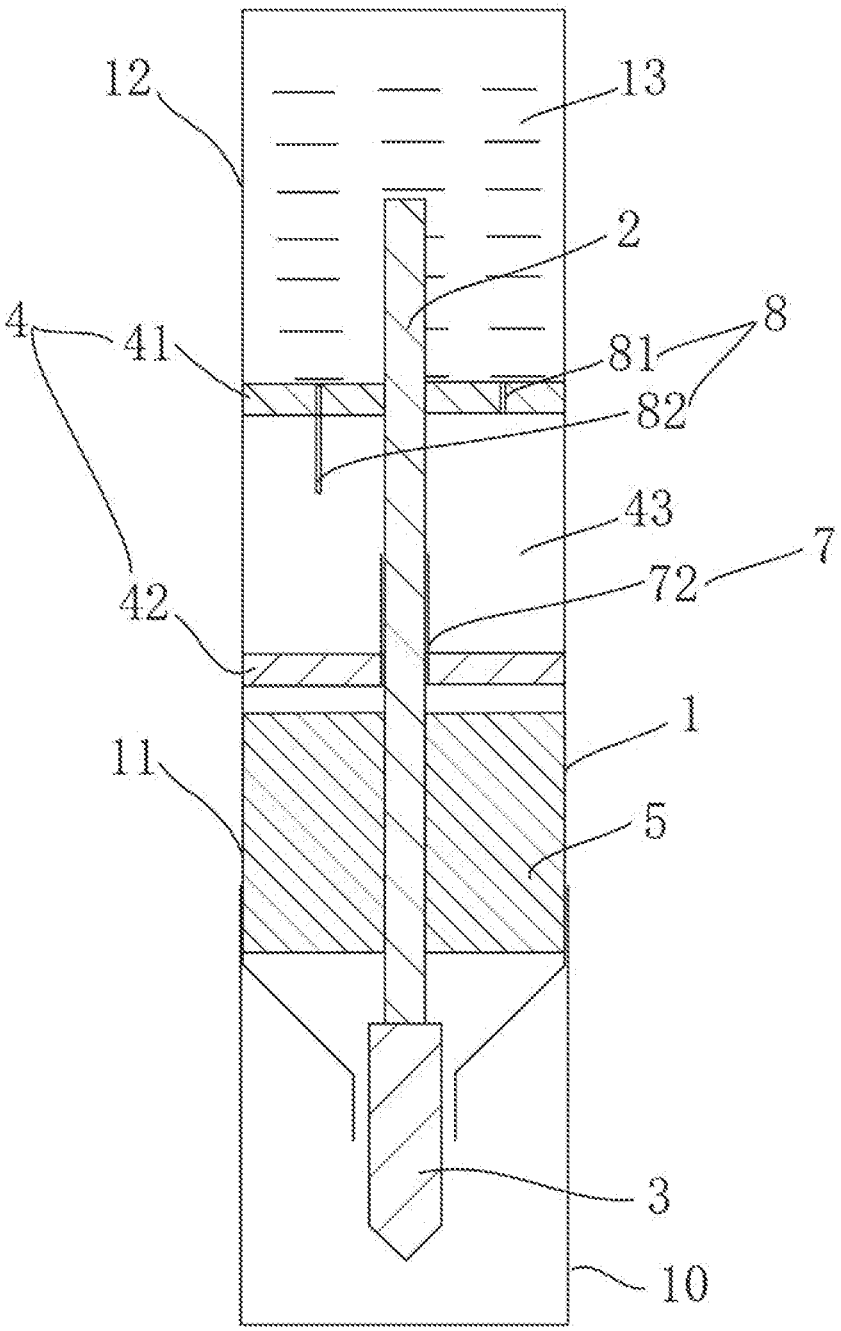
FIG. 8A is a cross-sectional front view of an eighth specific embodiment of the present invention.
Figure 8B:
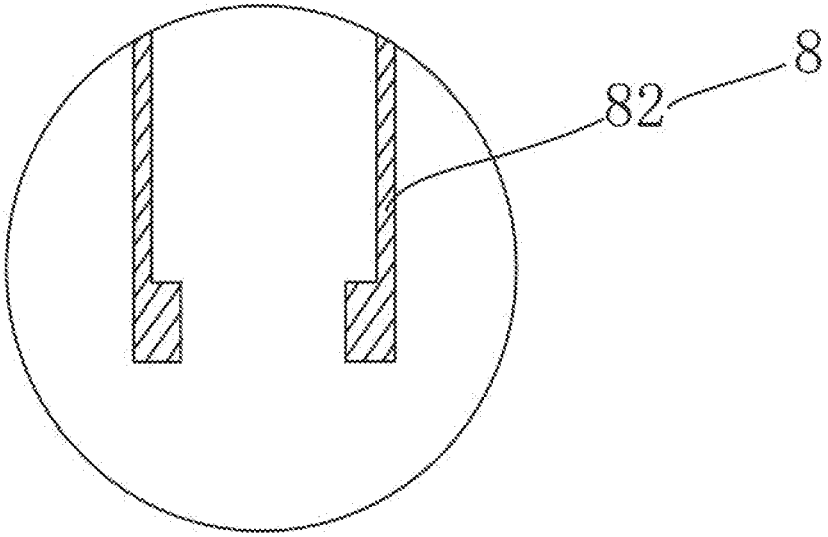
FIG. 8B is an enlarged cross-sectional view of the first air-guiding channel with tapered diameter in FIG. 8A.

Please see FIG. 8A and FIG. 8B, the structure and the working principle of Embodiment 8 of the present invention is similar to those of Embodiment 4, except that:

The end of the first air-guiding tube 82, away from the first baffle 41, is tapered in diameter. That is to say, the inner diameter of the end of the first air-guiding tube 82, away from the first baffle 41, is smaller than other inner diameters, as shown in FIG. 8B.

The cross section of the ink feeder 2 is circular as well as the cross section of the second air-guiding tube 72. The second air-guiding tube 72 is provided with convex ribs 45, wherein the convex ribs 45 abut against the ink feeder 2, so that ten gaps 46 are formed between the ink feeder 2 and the second air-guiding tube 72. The gaps are fan-shaped, similar to FIG. 1B, but the number of the convex ribs 45 is larger (of course, no convex ribs 45 but annular convex rib 45 can also be provided, thus the gap 46 is an annular hole, similar to that shown in FIG. 1C; for another example, the cross section of the second air-guiding tube 72 is hexagonal while that of the ink feeder 2 is circular, and the two are tangent to form six gaps 46, as shown in FIG. 1D). The gap 46 has a width of 0.1 mm, a thickness of 0.2 mm and a height of 3 mm. The gaps 46 are arranged at the end of the second air-guiding tube 72 close to the first baffle 41.

The pressure in the ink storage portion 12 is consistent with the outside in the initial state, and the ink 13 in the ink storage portion 12 penetrates into the first air-guiding hole 81 and the first air-guiding tube 82 to form a liquid seal. Therefore the air outside cannot be freely guided into the ink storage portion 12. During the writing process, the ink 13 in the ink storage portion 12 is transmitted to the nib 3 through the ink feeder 2. As the ink 13 is drawn out, the pressure in the ink storage portion 12 gradually decreases. When the negative pressure difference between the ink storage portion 12 and the outside is large enough, the differential pressure pushes the liquid seal up until the liquid seal is opened, the air entering the ink storage portion 12 until the pressure between the inside and the outside is rebalanced, and the liquid seal is re-formed in the first air-guiding hole 81 and the first air-guiding tube 82. This process is repeated until the ink 13 is used up.

When there is a relatively large positive differential pressure between the ink storage portion 12 and the external environment, for example, when it is transported by air or when the ink storage portion 12 is heated, the ink 13 is led out of the ink storage portion 12, and a part of the ink 13 is led out into the air barrier layer 43 through the first air-guiding hole 81. If the positive differential pressure is greater, the ink 13 will further be led out from the first air-guiding tube 82 into the air barrier layer 43, then penetrating into the gap 46 of the second air-guiding tube 72 to form a liquid seal. Therefore, the ink 13 will not permeate out of the second baffle 42 to enter into the writing portion 11, while a part of the ink 13 infiltrates through the ink feeder 2 and the excess ink 13 is formed at the lower part of the ink feeder 2. At this time, the buffer storage portion 5 absorbs the excess ink 13 at the lower part of the ink feeder 2 to prevent from leaking outside through the nib 3. When the external environment returns to normal, the ink storage portion 12 forms a negative differential pressure to the outside. At this time, the ink 13 is temporarily stored in the cavity of the adjusting portion 4, that is, the air barrier layer 43, the first air-guiding hole 81, the first air-guiding tube 82, the second air-guiding tube 72 and the buffer storage portion 5, will partially return to the ink storage portion 12. During the writing process, the remaining ink 13 stored in the cavity of the adjusting portion 4, the second air-guiding tube 72 and the buffer storage portion 5 will be preferentially released to the nib 3 through the ink feeder 2.

It should be noted that the end of the first air-guiding tube 82, far away from the first baffle 41, is tapered in diameter, which further improve the capacity of adjusting the external temperature and the pressure change of the adjusting portion 4. Under the condition of an end with a smaller tapered diameter, a very large positive pressure difference between the ink storage portion 12 and the ambient environment is required for the ink 13 that forms the liquid seal in the end with tapered diameter to enter the air barrier layer 43, so as to improve the ability of the adjusting portion 4 to resist the external temperature and pressure changes.

Embodiment 9

Figure 9:
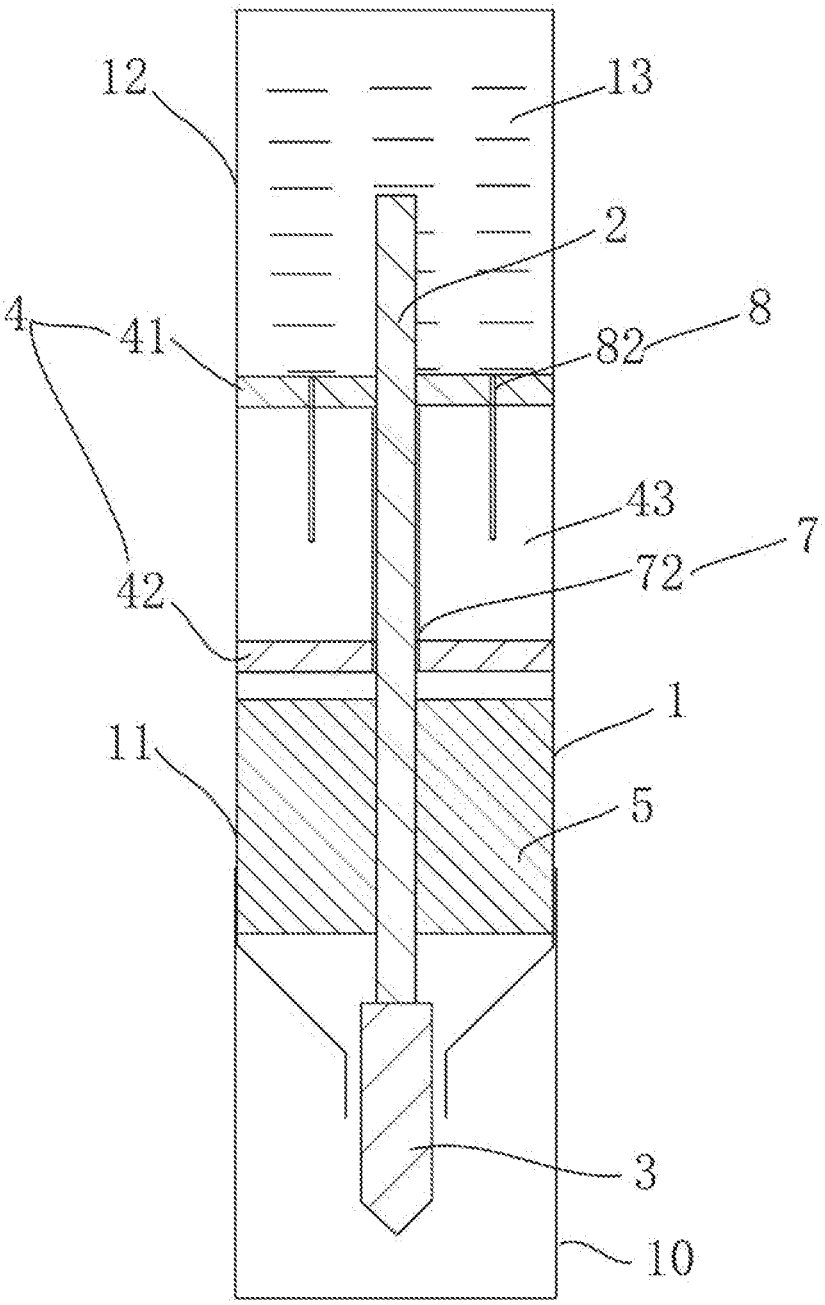
FIG. 9 is a cross-sectional front view of a ninth specific embodiment of the present invention.

Please see FIG. 9, the structure and the working principle of Embodiment 9 of the present invention is similar to those of Embodiment 7, except that:

The cross section of the ink feeder 2 is circular as well as the cross section of the second air-guiding tube 72. The portion of the second air-guiding tube 72 which extends along the longitudinal direction of the penholder 1 is provided with convex ribs 45, wherein the convex ribs 45 abut against the ink feeder 2, so that two gaps 46 are formed between the ink feeder 2 and the second air-guiding tube 72. The gaps are fan-shaped, similar to FIG. 1B, but the number of the convex ribs 45 is less (of course, no convex ribs 45 but annular convex rib 45 can also be provided, thus the gap 46 is an annular hole, similar to that shown in FIG. 1C; for another example, the cross section of the second air-guiding tube 72 is hexagonal while that of the ink feeder 2 is circular, and the two are tangent to form six gaps 46, similar to that shown in FIG. 1D). The gap 46 has a width of 1 mm, a thickness of 0.1 mm and a height of 36 mm.

In the initial state, the pressure in the ink storage portion 12 coincides with the external environment. The ink 13 in the ink storage portion 12 infiltrates into the first air-guiding tube 82 to form a liquid seal, and the outside air cannot be freely introduced into the ink storage portion 12. During the writing process, the ink 13 in the ink storage portion 12 is conducted to the nib 3 through the ink feeder 2. As the ink 13 is led out, the pressure inside the ink storage portion 12 gradually decreases. When the negative pressure between the ink storage portion 12 and outside is large enough, the differential pressure pushes the liquid seal up until the liquid seal is opened and the air enters the ink storage portion 12 until the inside and the outside rebalance, and the liquid seal is re-formed in the first air-guiding tube 82. This process is repeated until the ink 13 is used up.

When the positive pressure difference between the ink storage portion 12 and the external environment is relatively large, for example, when it is transported by air or when the ink storage portion 12 is heated, the ink 13 flows out from the ink storage portion 12, and a portion of the ink 13 flows into the air barrier layer 43 through the first air-guiding tube 82, then it infiltrates into the gap 46 of the second air-guiding tube 72 to form a liquid seal. Therefore, the ink 13 would not infiltrate out of the second baffle 42 to enter into the writing portion 11, while a portion of the ink 13 infiltrates through the ink feeder 2 and the excess ink 13 is formed at the lower part of the ink feeder 2. At this time, the buffer storage portion 5 absorbs the excess ink 13 at the lower of the ink feeder 2 to prevent the excess ink 13 from leaking outside through the nib 3. When the external environment returns to normal, the ink storage portion 12 forms a negative differential pressure to the outside. At this time, the ink 13 temporarily stored in the cavity of the adjusting portion 4, that is, the air barrier layer 43, the first air-guiding tube 82, the second air-guiding tube 72, and the buffer storage portion 5, will partially return to the ink storage portion 12. The remaining ink 13 stored in the cavity of the adjusting portion 4, the second air-guiding tube 72, and the buffer storage portion 5 is preferentially released to the nib 3 through the ink feeder 2 during the writing process.

Embodiment 10

Figure 10:
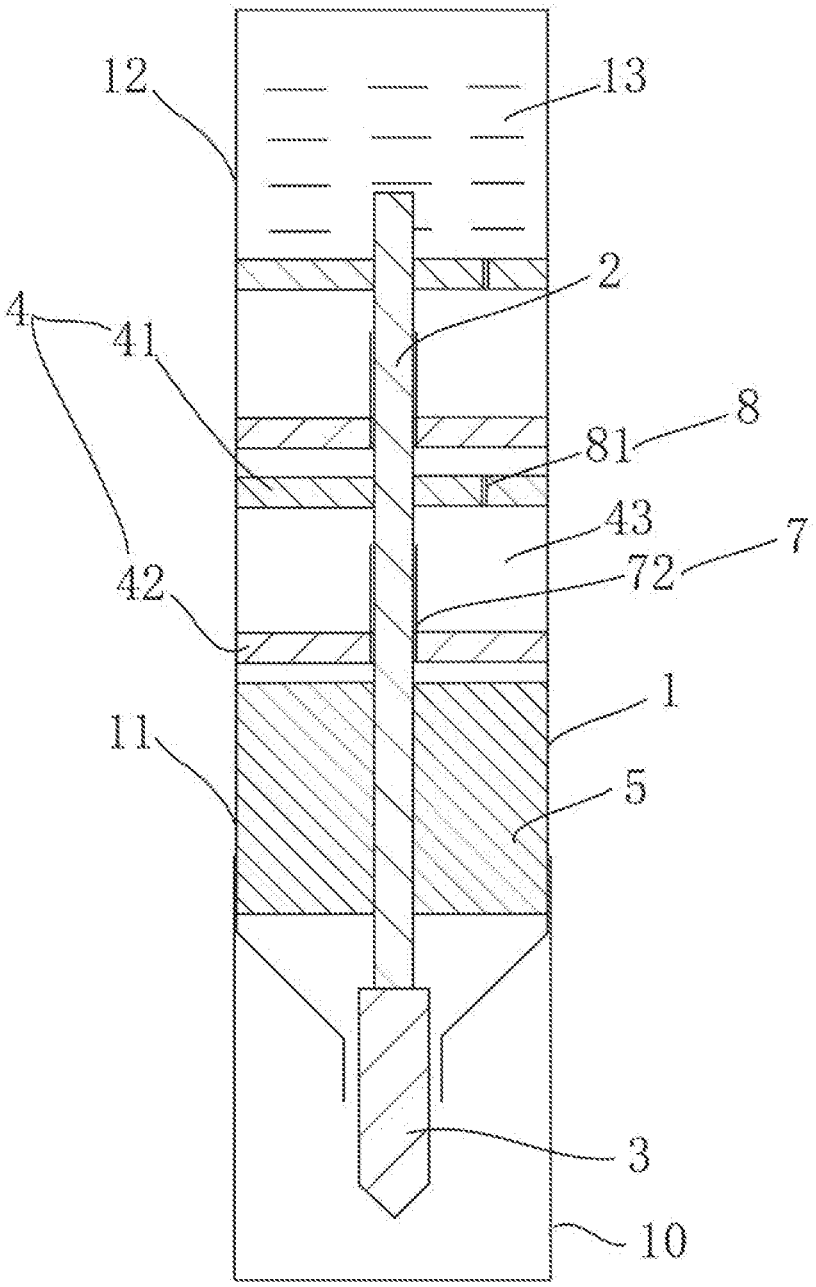
FIG. 10 is a cross-sectional front view of a tenth specific embodiment of the present invention.

Please see FIG. 10, the structure and the working principle of Embodiment 10 of the present invention is similar to those of Embodiment 2, except that:

The number of the adjusting portions 4 is two, and the two adjusting portions 4 are sequentially arranged along the longitudinal direction of the penholder 1, spaced from each other.

In the initial state, the pressure in the ink storage portion 12 equals the pressure outside, and the ink 13 in the ink storage portion 12 penetrates into the first air-guiding hole 81 to form a liquid seal. Therefore, the air outside cannot enter into the ink storage portion 12 freely. During the writing process, the ink 13 in the ink storage portion 12 is conducted to the nib 3 through the ink feeder 2. As the ink 13 is drawn out, the pressure in the ink storage portion 12 gradually decreases. When the negative pressure difference between the ink storage portion 12 and the outside is large enough, the differential pressure pushes the liquid seal up until the liquid seal is opened, the air entering into the ink storage portion 12 until the pressure inside and outside is rebalanced, and the liquid seal is re-formed in the first air-guiding hole 81 close to the adjusting portion 4 of the ink storage portion 12. This process is repeated until the ink 13 is used up.

When a relatively large positive pressure difference is formed between the ink storage portion 12 and the external environment, for example, when it is transported by air or when the ink storage portion 12 is heated, the ink 13 will be guided out from the ink storage portion 12, and a part of the ink 13 is guided out from the first air-guiding hole 81 close to the adjusting portion 4 of the ink storage portion 12 to enter into the air barrier layer 43 of this adjusting portion 4. If the positive pressure difference is larger, the ink 13 will be further guided into the second air-guiding tube 72 of the adjusting portion 4 so as to enter the space region between the two adjusting portions 4, and even be guided into the first air-guiding hole 81 of the adjusting portion 4 close to writing portion 11 to form a liquid seal, and even be further guided into the air barrier layer 43 of the adjusting portion 4. However, it will not permeate out of the second baffle 42 to enter into the writing portion 11, while other part of the ink 13 infiltrates through the ink feeder 2 and the excess ink 13 is formed at the lower part of the ink feeder 2. At this time, the buffer storage portion 5 absorbs the excess ink 13 at the lower of the ink feeder 2 to prevent the excess ink 13 from leaking outside through the nib 3. When the external environment returns to normal, the ink storage portion 12 forms a negative differential pressure to the outside. At this time, the ink 13 temporarily stored in the cavity of the adjusting portion 4, that is, the air barrier layer 43, the first air-guiding hole 81, the second air-guiding tube 72, the space region between the two adjusting portions 4, the first air-guiding hole 81 of the adjusting portion 4 close to the writing portion 11, the second air-guiding tube 72, the air barrier layer 43 and the buffer storage portion 5, will partially return to the ink storage portion 12. The remaining ink 13 stored in the cavity of the adjusting portion 4, the second air-guiding tube 72, and the buffer storage portion 5 is preferentially released to the nib 3 through the ink feeder 2 during the writing process.

It should be noted that the adjusting portions 4 used in series help to improve the ability of the adjusting portion 4 to withstand the changes of temperature and pressure. When the adjusting portions 4 are provided, the capacity of resisting external temperature and pressure changes of the adjusting portion 4 can be improved, and the space region between the two adjusting portions 4 also helps to improve the capacity of resisting external temperature and pressure changes. Therefore, the capacity of the adjusting portion 4 resisting the external temperature and pressure changes is improved.

Embodiment 11

Figure 11A:
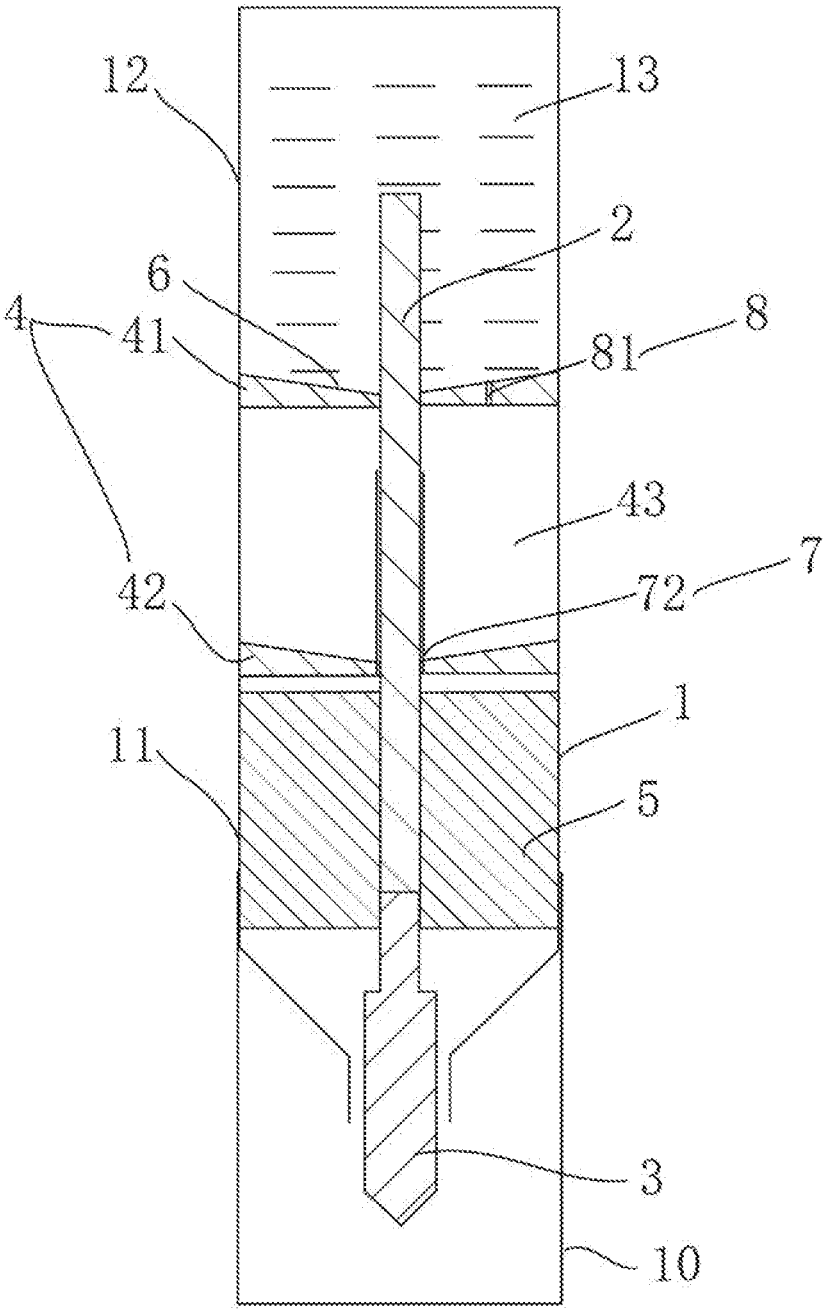
FIG. 11A is a cross-sectional front view of an eleventh specific embodiment of the present invention.
Figure 11B:
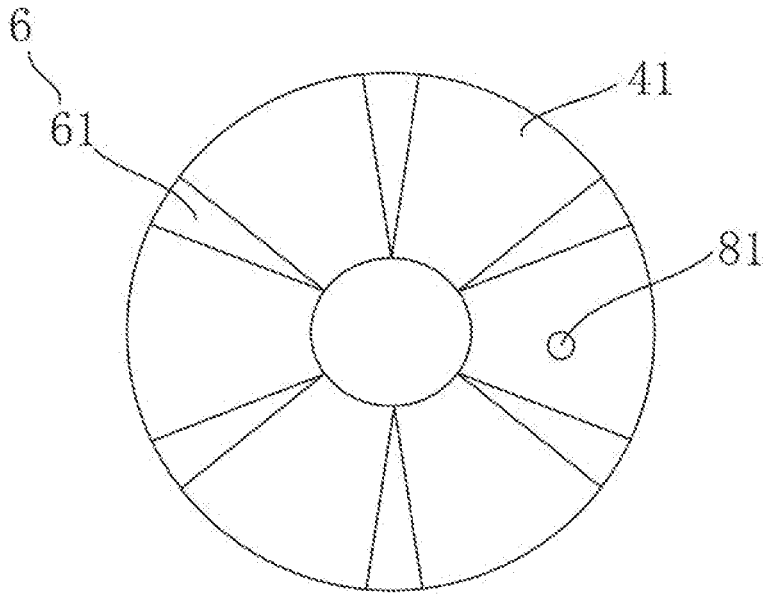
FIG. 11B is a cross-sectional top view of a first baffle in the eleventh specific embodiment of the present invention.
Figure 11C:
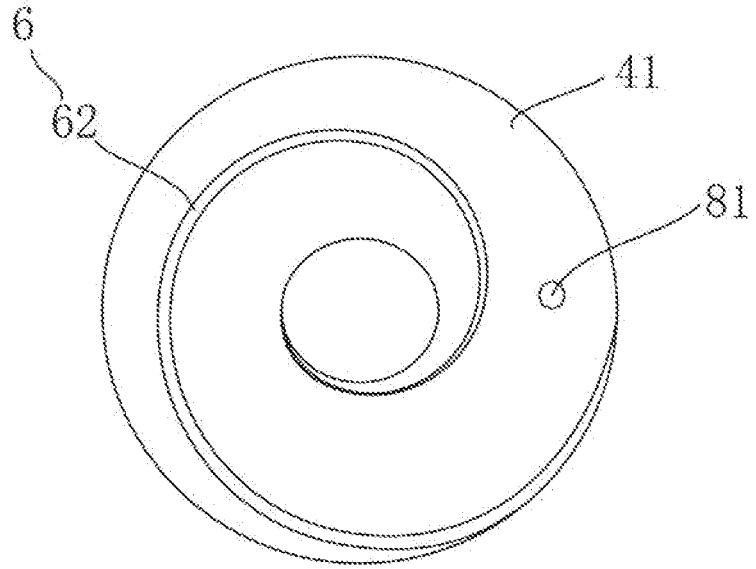
FIG. 11C is a cross-sectional top view of the ink-guiding groove of the first baffle being a spiral groove of the present invention.

Please see FIG. 11A, the structure and the working principle of Embodiment 11 of the present invention are similar to those of Embodiment 2, except that:

The surface of the first baffle 41 toward the ink storage portion 12 is provided with an ink-guiding groove 6 along the direction toward the ink feeder 2. Specifically, the ink-guiding groove 6 is a wedge-shaped groove 61, and the width of the wedge-shaped groove 61 tapers along the direction close to the ink feeder 2 (as shown in FIG. 11B). The surface of the first baffle 41 toward the ink storage portion 12 is obliquely arranged along the direction of the ink storage portion 12 to the writing portion 11. That is, the surface and the ink feeder 2 forms an acute angle, so that the height of the wedge-shaped groove 61 is gradually reduced along the direction close to the ink feeder 2 (As shown in FIG. 11A) (the ink-guiding groove 6 can also be other shapes such as a spiral groove 62 shown in FIG. 11C). The second baffle 42 is also provided with an ink-guiding groove 6, and the specific shape of the ink-guiding groove 6 is the same as or different from that of the first baffle 41. In this present embodiment, the specific shape of the ink-guiding groove 6 is the same as that of the ink-guiding groove 6 of the first baffle 41. When the ink 13 in the ink storage portion 12 is little and the writing instrument is transversely arranged, the ink 13 is easily siphoned into the ink feeder 2 through the wedge-shaped groove 61, so as to continuously supply ink to the ink feeder 2. Moreover, such structure also facilitates to use up the ink 13 in the ink storage portion 12 as much as possible.

In addition, the buffer storage portion 5 is arranged in the writing portion 11 and wraps a portion of ink feeder 2 in the writing portion 11 as well as a portion of the nib 3 in the writing portion 11. That is, the contact part of the upper part of the nib 3 and the lower part of the ink feeder 2 rises up to the inside of the buffer storage portion 5. Therefore, such structure facilitates to prevent the ink 13 from leaking from the nib 3, due to the pressure difference or temperature difference between the ink storage portion 12 and the outside.

After testing, it shows that the direct-liquid writing instrument provided by Embodiment 1 to 11 of the invention is of high performance, good writing quality, uniformity of ink discharging, consistency in before and after, and stability of ink discharging quantity; long unit writing length, less residuals, high ink utilization efficiency as wells as environment-friendly performance, good temperature-resistant performance (high temperature 50° C. storage and transportation) and pressure-resistant performance, prevention of ink leakage and even when the nib is inverted.

In order to further highlight the advantages of this present invention, the following performance comparison embodiments are listed.

Performance Comparison of Embodiment 1

100 pieces of the direct-liquid writing instruments of this present invention as shown in Embodiment 4 are manufactured, and another 100 pieces of the comparative direct-liquid writing instruments with inverted adjusting portion are manufactured. A vibration test of the 1A test program of ISTA (International Safe Transit Association) transport test program is adopted. After the vibration test, eight pieces of the comparative direct-liquid writing instruments started to leak ink to the buffer storage portion 5, as the color of the buffer storage portion 5 changed from colorless to the color of the ink itself, whereas the direct-liquid writing instruments in this present invention failed to leak ink to the buffer storage portion 5, as the color of the buffer storage portion 5 remains colorless.

Performance Comparison of Embodiment 2

100 pieces of direct-liquid writing instrument of this present invention as shown in Embodiment 7 are manufactured, and another 100 pieces of the comparative direct-liquid writing instruments with inverted adjusting portion are manufactured. A vibration test of the 1A test program of ISTA (International Safe Transit Association) transport test program is adopted. After the vibration test, seven pieces of the comparative direct-liquid writing instruments started to leak ink to the buffer storage portion 5, as the color of the buffer storage portion 5 changed from colorless to the color of the ink itself, whereas the direct-liquid writing instruments in this present invention failed to leak ink to the buffer storage portion 5, as the color of the buffer storage portion 5 remains colorless.

Performance Comparison of Embodiment 3

100 pieces of direct-liquid writing instrument of this present invention as shown in Embodiment 8 are manufactured, and another 100 pieces of the comparative direct-liquid writing instruments with inverted adjusting portion are manufactured. A vibration test of the 1A test program of ISTA (International Safe Transit Association) transport test program is adopted. After the vibration test, five pieces of the comparative direct-liquid writing instruments started to leak ink to the buffer storage portion 5, as the color of the buffer storage portion 5 changed from colorless to the color of the ink itself, whereas the direct-liquid writing instruments in this present invention failed to leak ink to the buffer storage portion 5, as the color of the buffer storage portion 5 remains colorless.

It should be noted that the capability of ink absorption of the buffer storage portion 5 preferably is no stronger than that of the ink feeder 2, and the buffer storage portion 5 rarely absorbs the ink 13 from the ink feeder 2 in a general condition of storage and writing. However, when the excess ink 13 leaks out from the ink feeder 2, since the differential pressure or the differential temperature between the ink storage portion 12 and the outside exists, the excess ink 13 can be absorbed by the buffer storage portion 5.

According to the present invention, the writing instrument not only has large ink capacity, less amount of residuals, and smoothness and uniformity in writing, but also it is not easy to leak even if the external temperature and the pressure vary greatly. Additionally, it greatly reduces the amount of ink residuals; it also has the advantages of simple and stable structure, easy availability of raw materials, simple production, resistance to pressure and temperature difference, convenience to transport, high ink utilization rate, convenience to use, and less waste and environmental pollution It should be understood by those skilled in the art that the embodiments of the present invention as shown in the above description and drawings are only used as examples and do not limit the invention. For example, the above embodiments may have many deformation modes. For example, the cross sections of the first air-guiding channel and the second air-guiding channel are not circular. For example, it could be triangular, square or polygonal. The number of the gaps can be larger than two, which can be formed by other means mentioned above, and the shape of the gap is arbitrary. The position of the gaps can be set at any position of the second air-guiding channel; the number of the air-guiding tube can also be larger than two, in contact with or spaced from each other. The number of regulators can be larger than two, arranged in series and provided with or without gap(s) between them. The ink can be replaced by cosmetic liquid such as eyebrow liquid to form a cosmetic pen such as an eyebrow pencil. Therefore, the writing instrument here refers broadly to all the instruments that guide the liquid in a closed cavity through the ink feeder for writing (smearing), including but not limited to highlighter pens, whiteboard pens, sign pens, eyebrow pencils, etc.

Therefore, it can be seen that the purposes of the invention have been achieved completely and effectively. The functions and structural principles of the present invention are shown and described in the embodiments. The implementation mode can be modified randomly without deviating from the principle. Therefore, the present invention provides all the deformation embodiments based on the spirit of the claims and the scope of the claims.

The invention claimed is:

1. A direct-liquid writing instrument, comprising a penholder, an ink feeder and a nib, wherein one end of the penholder is provided with a writing portion, the other end of the penholder is provided with an ink storage portion, and the nib is partially inserted into the writing portion, said direct-liquid writing instrument further comprising:

an adjusting portion, comprising a first baffle and a second baffle, wherein the first baffle and the second baffle are spaced apart so that an air barrier layer is formed between the two baffles, the first baffle is in contact with the ink of the ink storage portion, the second baffle is adjacent to the writing portion, the ink feeder passes through the first baffle, the air barrier layer, and the second baffle, two ends of the ink feeder are in contact with the ink and the nib respectively so as to deliver the ink to the nib, the first baffle is provided with a first air-guiding channel, through the first air-guiding channel the ink storage portion is connected to the air barrier layer, a second air-guiding channel is provided between the second baffle and the ink feeder, wherein at least one gap is formed between the second air-guiding channel and the ink feeder, and the air barrier layer is connected to the writing portion through the second air-guiding channel.

2. The direct-liquid writing instrument according to claim 1, wherein the first air-guiding channel is a first air-guiding hole and/or a first air-guiding tube, and the first air-guiding hole/tube extends into the air barrier layer.

3. The direct-liquid writing instrument according to claim 1, wherein the dimension of the adjusting portion along the longitudinal direction of the penholder is from 2 mm to 50 mm, or from 10 mm to 30 mm.

4. The direct-liquid writing instrument according to claim 1, wherein the dimension of the first air-guiding channel in the air barrier layer extending along the longitudinal direction of the penholder is from 0 to a value of the dimension of the air barrier layer along the longitudinal direction of the penholder, or from 5 mm to 20 mm.

5. The direct-liquid writing instrument according to claim 1, wherein the diameter of the first air-guiding channel is from 0.1 mm to 3 mm, or from 0.5 mm to 1.5 mm.

6. The direct-liquid writing instrument according to claim 1, wherein the end of the first air-guiding channel, away from the first baffle, is tapered in diameter.

7. The direct-liquid writing instrument according to claim 1, wherein the first air-guiding channel is provided in plural, and the plurality of the first air-guiding channels are in contact with or spaced from each other.

8. The direct-liquid writing instrument according to claim 1, wherein the second air-guiding channel is a second air-guiding hole and/or a second air-guiding tube, and the second air-guiding hole/tube extends into the air barrier layer.

9. The direct-liquid writing instrument according to claim 1, wherein the dimension of the second air-guiding channel in the air barrier layer extending along the longitudinal direction of the penholder is from 0 to a value of the dimension of the air barrier layer along the longitudinal direction of the penholder, or from 5 mm to 20 mm.

10. The direct-liquid writing instrument according to claim 1, wherein the diameter of the second air-guiding channel is greater than the diameter of the ink feeder by 0.05 mm to 2 mm, or by 0.2 mm to 0.8 mm.

11. The direct-liquid writing instrument according to claim 1, wherein the gap is formed at the end of the second air-guiding channel adjacent to the first baffle, the air barrier layer is connected to the interior of the second air-guiding channel through the gap, and the interior of the second air-guiding channel is connected to the writing portion.

12. The direct-liquid writing instrument according to claim 1, wherein the width of the gap is the distance of the gap along the circumferential direction of the ink feeder, being from 0.1 mm to a value of the dimension surrounding the entire ink feeder, or from 0.3 mm to 1.0 mm.

13. The direct-liquid writing instrument according to claim 1, wherein the thickness of the gap is the distance of the gap along the radial direction of the ink feeder, being from 0.02 mm to 0.2 mm, or from 0.04 mm to 0.1 mm.

14. The direct-liquid writing instrument according to claim 1, wherein the height of the gap is the distance of the gap along the length of the penholder, being from 0.1 mm to a value of the dimension of the second air-guiding channel in the air barrier layer extending along the longitudinal direction of the penholder, or from 1.0 mm to 3.0 mm.

15. The direct-liquid writing instrument according to claim 1, wherein the shape of the gap is annular, rectangular or fan-shaped.

16. The direct-liquid writing instrument according to claim 1, wherein the number of the gaps is plural.

17. The direct-liquid writing instrument according to claim 16, wherein the number of the gaps is from 2 to 4.

18. The direct-liquid writing instrument according to claim 1, wherein the number of the adjusting portions is plural, and the plurality of the adjusting portions are sequentially provided along the longitudinal direction of the penholder, in contact with or spaced from each other.

19. The direct-liquid writing instrument according to claim 1, wherein the surface of the first baffle toward the ink storage portion is provided with an ink-guiding groove along the direction toward the ink feeder.

20. The direct-liquid writing instrument according to claim 19, wherein the ink-guiding groove is a spiral groove and/or a wedge-shaped groove.

21. The direct-liquid writing instrument according to claim 19, wherein the width of the ink-guiding groove tapers in the direction toward the ink feeder, and/or the surface is leaned along the direction from the ink storage portion to the writing portion.

22. The direct-liquid writing instrument according to claim 1, further comprising:

a buffer storage portion, provided in the writing portion and wrapping at least a portion of ink feeder in the writing portion so as to absorb the excess ink exuding from the ink feeder.

23. The direct-liquid writing instrument according to claim 22, wherein the buffer storage portion also wraps a portion of the nib in the writing portion.

24. The direct-liquid writing instrument according to claim 1, wherein the other end of the penholder is detachably provided with the ink storage portion.

* * * * *